US006619166B2

(12) United States Patent
Miyazaki et al.

(10) Patent No.: US 6,619,166 B2
(45) Date of Patent: Sep. 16, 2003

(54) PRINTING APPARATUS WITH CUTTER AND IMAGE PRINTING AND CUTTING METHOD

(75) Inventors: Takao Miyazaki, Asaka (JP); Noboru Komori, Asaka (JP); Koji Ichikawa, Asaka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 224 days.

(21) Appl. No.: 09/730,851

(22) Filed: Dec. 7, 2000

(65) Prior Publication Data

US 2001/0000222 A1 Apr. 12, 2001

Related U.S. Application Data

(62) Division of application No. 09/225,491, filed on Jan. 6, 1999, now Pat. No. 6,209,435.

(30) Foreign Application Priority Data

Jan. 7, 1998 (JP) ..... 10-001843
Jan. 7, 1998 (JP) ..... 10-001844

(51) Int. Cl.[7] ..... B26D 1/12; B26D 5/00

(52) U.S. Cl. ..... 83/13; 83/72; 83/665; 83/300; 83/368; 83/669

(58) Field of Search ..... 83/665, 72, 300, 83/368, 522.11, 522.15, 669, 13, 861, 43, 44, 73, 76.9, 286; 700/233, 235, 237, 242; 396/2, 429

(56) References Cited

U.S. PATENT DOCUMENTS 272,354 A 2/1883 Titus ..... 83/300
4,549,454 A 10/1985 Yamashita ..... 83/300
4,646,327 A * 2/1987 Kojima et al. ..... 375/296
4,799,172 A * 1/1989 Wood et al. ..... 358/1.3
4,805,501 A 2/1989 Nuttin ..... 83/300
4,873,643 A * 10/1989 Powell et al. ..... 700/103
5,017,953 A * 5/1991 Biondo, Jr. ..... 396/2
5,029,099 A * 7/1991 Goodman ..... 700/233
5,036,472 A * 7/1991 Buckley et al. ..... 700/233
5,038,293 A * 8/1991 Goodman ..... 700/233

(List continued on next page.)

FOREIGN PATENT DOCUMENTS

DK 47527 7/1933 ..... 83/300
EP 1223461 * 7/2002
FR 1002253 3/1952 ..... 83/300
JP 9-66636 3/1997 ..... B41J/11/70
JP 9-226194 9/1997 ..... B41J/11/66
JP 101953 * 7/2000

*Primary Examiner*—M. Rachuba
(74) *Attorney, Agent, or Firm*—Sughrue Mion, PLLC

(57) ABSTRACT

Image data representing an image to be printed is captured, and a cutting pattern for cutting the outer form of an image printed on recording paper is selected from a plurality of different cutting patterns. In accordance with the captured image data, one or more images are printed on the recording paper in sizes and layout proper for the selected cutting pattern. Then, the outer forms of one or more images are cut on the recording paper in the selected cutting pattern. This eliminates the necessity of entering the size and layout of the image to be printed on the recording paper and editing a cutting method. Moreover, one or more images can be printed on the recording paper in a desired size and layout, and the outer forms of one or more images are cut on the recording paper in a desired cutting pattern.

23 Claims, 23 Drawing Sheets

U.S. PATENT DOCUMENTS 5,039,848 A * 8/1991 Stoken ..... 235/381
5,132,915 A * 7/1992 Goodman ..... 700/233
5,216,614 A 6/1993 Kuchta et al. ..... 83/72
5,333,111 A 7/1994 Chaiken et al. ..... 83/72
5,349,534 A * 9/1994 Rousseff et al. ..... 700/235
5,362,374 A * 11/1994 Chang ..... 205/164
5,405,475 A * 4/1995 Kraft et al. ..... 156/275.5
5,487,010 A * 1/1996 Drake et al. ..... 700/233
5,761,982 A 6/1998 Abt et al. ..... 83/861
5,789,050 A 8/1998 Kang ..... 428/42.3
5,791,215 A 8/1998 Morrison et al. ..... 83/368
5,930,810 A * 7/1999 Farros et al. ..... 707/506
5,942,065 A * 8/1999 Biggs et al. ..... 156/90
5,993,048 A * 11/1999 Banks et al. ..... 700/233
6,047,130 A * 4/2000 Oles ..... 396/1
6,085,195 A * 7/2000 Hoyt et al. ..... 707/10
6,116,906 A * 9/2000 Rifkin ..... 434/105
6,123,362 A * 9/2000 Squilla et al. ..... 283/67
6,179,161 B1 * 1/2001 Kovens et al. ..... 221/131
6,209,435 B1 * 4/2001 Miyazaki et al. ..... 83/665
6,385,628 B1 * 5/2002 Massarsky ..... 707/502
6,396,963 B2 * 5/2002 Shaffer et al. ..... 382/305
6,408,132 B1 * 6/2002 Ishikawa ..... 396/2
6,434,579 B1 * 8/2002 Shaffer et al. ..... 707/520
6,484,901 B1 * 11/2002 Kim ..... 221/7
2002/0154905 A1 * 10/2002 Maeda et al. ..... 396/2

* cited by examiner

FIRST CUTTING PATTERN

SECOND CUTTING PATTERN

THIRD CUTTING PATTERN

FOURTH CUTTING PATTERN

FIFTH CUTTING PATTERN

PRINTING APPARATUS WITH CUTTER AND IMAGE PRINTING AND CUTTING METHOD

This is a divisional of Application No. 09/225,491 filed Jan. 6, 1999 now U.S. Pat. No. 6,209,435, the disclosure of which is incorporated herein by reference.

BACKGROUND OF THF INVENTION

1. Field of the Invention

The present invention relates generally to a printing apparatus with a cutter and an image printing and cutting method, and more particularly to a printing apparatus with a cutter and an image printing and cutting method for printing one or more images on recording paper in a desired size and layout and cutting the outer form of one or more printed images on the recording paper on which the images are printed.

2. Description of Related Art

Japanese Patent Provisional Publication No. 9-66636 discloses a conventional printing apparatus with a cutter, in which the outer form of a label is designated first, and then the size of characters to be printed, designation of a font for the characters, and the characters are entered. The printing apparatus prints the characters on recording paper in accordance with the entered data. Then, the printing apparatus moves the paper along the X-axis in accordance with the entered outer form of the label, and moves a single cutter edge along the Y-axis to cut the outer form of the label. The label can be cut into an arbitrary shape such as an oval, cloud, heart, and star.

In this printing apparatus, since the outer form of the label is designated first and the size of printed characters, the designation of the font and the characters are entered second, the size of printed characters, the designation of the font and the characters have to be entered according to the outer form of the label. For this reason, it is complicated to edit the label in order to acquire a desired label.

Japanese Patent Provisional Publication No. 9-226194 discloses another conventional printing apparatus with a cutter, in which an image to be printed is captured and displayed, and the image is edited for printing as the need arises. The designation of the cutting area and coordinates of the image controls one or more cutters, which cut the recording paper horizontally and vertically. Then, the printed image can be cut in the designated cutting area.

In this printing apparatus, the cutting area, etc. has to be designated for the captured image or the edited image obtained by editing the captured image. For this reason, it is complicated to edit the cutting method. The printing apparatus can cut the recording paper vertically and horizontally and cut the aligned images quickly, but it cannot cut the image into an arbitrary shape.

SUMMARY OF THE INVENTION

The present invention has been developed in view of the above-described circumstances, and has as its object the provision of a printing apparatus with a cutter and an image printing and cutting method wherein it is unnecessary to enter a size and layout of an image to be printed on recording paper and edit a cutting method, one or more images can be printed on the recording paper in a desired size and layout, and the outer forms of one or more images are cut on the recording paper in a desired cutting pattern.

The present invention is directed to a printing apparatus comprising: an image data capturer for capturing image data representing an image to be printed; a cutting pattern selector for selecting a cutting pattern from a plurality of cutting patterns; a printing part for printing at least one image represented by the captured image data in a size and layout proper for the selected cutting pattern onto recording paper; and a cutting part for cutting an outer form of at least one printed image on the recording paper in accordance with the selected cutting pattern.

According to the present invention, a desired cutting pattern is selected from the plurality of cutting patterns, so that one or more images can be printed on the recording paper in the size and layout proper for the selected cutting pattern, and the outer forms of one or more images can be cut on the recording paper in the selected cutting pattern.

The present invention is also directed to a printing apparatus comprising: an image data capturer for capturing image data representing an image to be printed; a cutting pattern selector for selecting a cutting pattern from a plurality of cutting patterns; a storage part for storing a plurality of pieces of template image data representing a plurality of template images; a template image selector for selecting one template image from the plurality of template images; an image processor for creating composite image data representing a composite image composed from the image to be printed and the selected template image by combining the captured image data and the template image data representing the selected template image; a printing part for printing at least one composite image in a size and layout proper for the selected cutting pattern onto recording paper; and a cutting part for cutting an outer form of at least one printed image on the recording paper in accordance with the selected cutting pattern.

According to the present invention, only if a desired cutting pattern is selected from the plurality of cutting patterns and a template image combined with the image to be printed is selected from the plurality of template images, one more composite images can be printed on the recording paper and the outer forms of one or more composite images can be cut on the recording paper in accordance with the selected cutting pattern.

The plurality of cutting patterns includes a cutting pattern in which a part of the images printed on the recording paper remains uncut. The cutting part comprises: a plurality of cutters provided with punching dies corresponding to the plurality of cutting patterns; and a cutter holder for holding the plurality of cutters, the cutter holder moving one of the plurality of cutters providing the selected cutting pattern to a cutting position such that the one of the plurality of cutters cuts the printed image on the recording paper. The plurality of pieces of template image data, stored in the storage part, and the plurality of cutters, provided on the cutting part, are addable and/or interchangeable. Each of the plurality of cutters has a type indicator for indicating a type of the cutter; and the cutting part recognizes the types of the plurality of cutters held by the cutter holder associated with positions of the plurality of cutters on the cutter holder by reading the type indicators of the plurality of cutters prior to the cutting. The type indicators are barcodes.

The plurality of cutters are cutter rollers, the punching dies being provided on circumferential surfaces of the cutter rollers. The recording paper is used for producing at least one peel-off sticker, the recording paper comprising sticker paper and backing paper, the sticker paper being attached on the backing paper, the image being printed on the sticker paper; and the cutting part cuts only the sticker paper and leaves the backing paper uncut. The recording paper is roll paper used for producing at least one peel-off sticker, the roll paper comprising sticker paper and backing paper, the sticker paper being attached on the backing paper, the image being printed on the sticker paper; each of the cutter rollers has a cutting edge on the circumferential surface along a generatrix of the circumferential surface; and the punching dies cut only the sticker paper and leave the backing paper uncut, and the cutting edges cut the roll paper to a predetermined length by cutting both the sticker paper and the backing paper.

Each of the cutter rollers has a phase indicator for indicating a phase of the cutter roller; and the cutting part initializes the phase of the cutter roller by detecting the phase indicator while rotating the cutter roller, and phases the cutter roller with the recording paper to cut the recording paper. The type indicator serves as the phase indicator.

The printing apparatus according to the present invention further comprises: a paper feeder for feeding the recording paper to the printing part to print the image on the recording paper, and feeding the recording paper on which the image has been printed to the cutting part to cut the recording paper; wherein the printing part prints a positioning indicator as a reference for a cutting position onto the recording paper; and wherein the cutting part further comprises a sensor for outputting a detection signal upon detecting the positioning indicator on the recording paper while the paper feeder is feeding the recording paper, the cutting part operating in accordance with the detection signal.

The present invention is also directed to an image printing and cutting method comprising the steps of: capturing image data representing an image to be printed; selecting a cutting pattern from a plurality of cutting patterns; printing at least one image represented by the captured image data in a size and layout proper for the selected cutting pattern onto recording paper; and cutting an outer form of at least one printed image on the recording paper in accordance with the selected cutting pattern.

According to the present invention, only if a desired cutting pattern is selected from the plurality of cutting patterns, one or more images can be printed on the recording paper in the size and layout proper for the selected cutting pattern and the outer forms of one or more images can be cut on the recording paper in the selected cutting pattern.

The present invention is also directed to an image printing and cutting method comprising the steps of: capturing image data representing an image to be printed; selecting a cutting pattern from a plurality of cutting patterns; selecting a template image proper for the selected cutting pattern from a plurality of template images represented by a plurality of pieces of template image data; creating composite image data representing a composite image composed from the image to be printed and the selected template image by combining the captured image data and the template image data representing the selected template image; printing at least one composite image in a size and layout proper for the selected cutting pattern onto recording paper; and cutting an outer form of at least one printed image on the recording paper in accordance with the selected cutting pattern.

According to the present invention, only if a desired cutting pattern is selected from the plurality of cutting patterns and a template image combined with the image to be printed is selected from the plurality of template images, one more composite images can be printed on the recording paper and the outer forms of one or more composite images can be cut on the recording paper in accordance with the selected cutting pattern. The cutting pattern selecting step comprises the step of displaying the cutting patterns on a display screen, the cutting pattern being selected on the display screen. The template image selecting step comprises the step of displaying only the template images proper for the selected cutting pattern on the display screen, the template image being selected on the display screen.

The present invention is also directed to an image printing and cutting method comprising the steps of: capturing image data representing an image to be printed; selecting a template image from a plurality of template images represented by a plurality of pieces of template image data; selecting a cutting pattern proper for the selected template image from a plurality of cutting patterns; creating composite image data representing a composite image composed from the image to be printed and the selected template image by combining the captured image data and the template image data representing the selected template image; printing at least one composite image in a size and layout proper for the selected cutting pattern onto recording paper; and cutting an outer form of at least one printed image on the recording paper in accordance with the selected cutting pattern.

The template image selecting step comprises the step of displaying the template images on a display screen, the template image being selected on the display screen. The cutting pattern selecting step comprises the step of displaying only the cutting patterns proper for the selected template image on a display screen, the cutting pattern being selected on the display screen. If the selected cutting pattern includes at least two cutting shapes, the template images respectively proper for the cutting shapes are selected in the template image selecting step.

The recording paper is a sheet of paper used for producing at least one peel-off sticker, the sheet comprising sticker paper and backing paper, the sticker paper being attached on the backing paper; the image is printed on the sticker paper in the printing step; and only the sticker paper is cut and the backing paper is left uncut in the cutting step. The recording paper is roll paper used for producing at least one peel-off sticker, the roll paper comprising sticker paper and backing paper, the sticker paper being attached on the backing paper; the image is printed on the sticker paper in the printing step; only the sticker paper is cut and the backing paper is left uncut in the cutting step; and the image printing and cutting method further comprises the step of cutting the roll paper to a predetermined length by cutting both the sticker paper and the backing paper.

The image printing and cutting method of the present invention further comprises: the step of providing a plurality of cutters provided with punching dies corresponding to the plurality of cutting patterns; wherein one of the plurality of cutters providing the selected cutting pattern is used in the cutting step. It is therefore possible to quickly cut out one or more images from the recording paper.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENT

This invention will be described in further detail by way of example with reference to the accompanying drawings.

Figure 1:
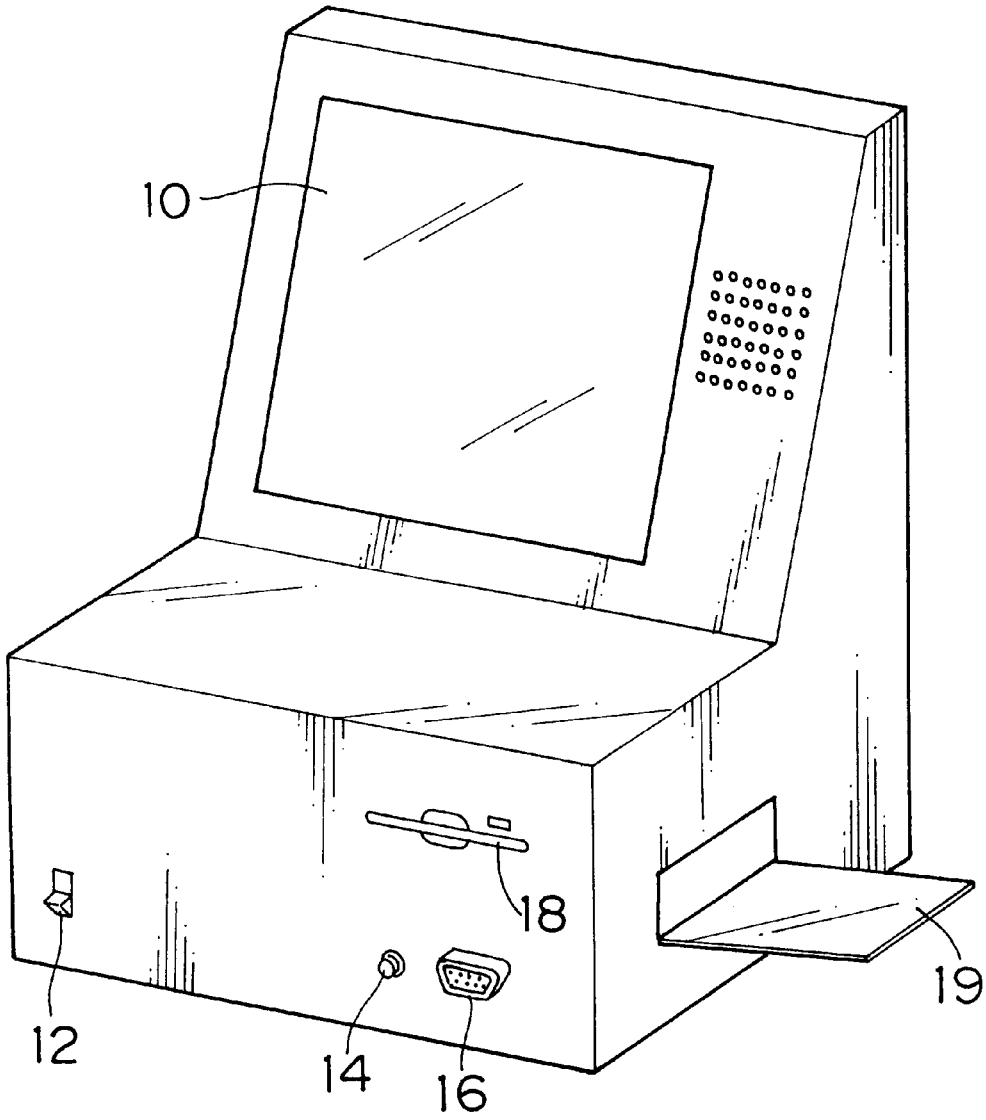
FIG. 1 is a view illustrating the appearance of a printing apparatus with a cutter according to an embodiment of the present invention.

FIG. 1 is a view illustrating the appearance of a printing apparatus with a cutter according to an embodiment of the present invention.

In FIG. 1, reference numeral 10 is a display or an LCD panel, 12 is a power switch, 14 is a video signal input terminal, 16 is a parallel terminal to be connected to external equipment, 18 is an insertion opening into which an external recording medium such as a floppy disk and a memory card is inserted, and 19 is a paper exit tray. The LCD panel 10 has a touch sensor enabling a user to enter commands by touching buttons and scroll bars displayed on a screen.

Figure 2:
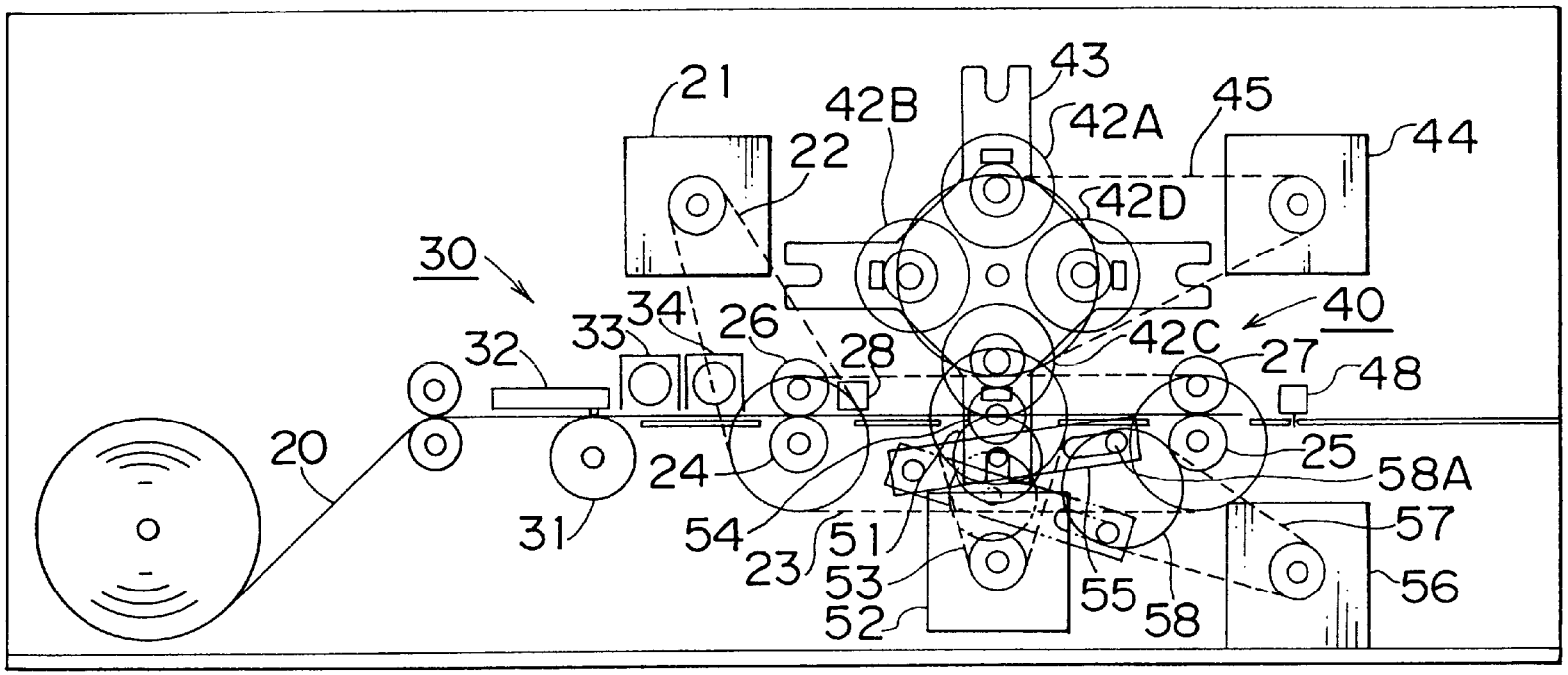
FIG. 2 is a front view illustrating the outline inner structure of the printing apparatus in FIG. 1.
Figure 3:
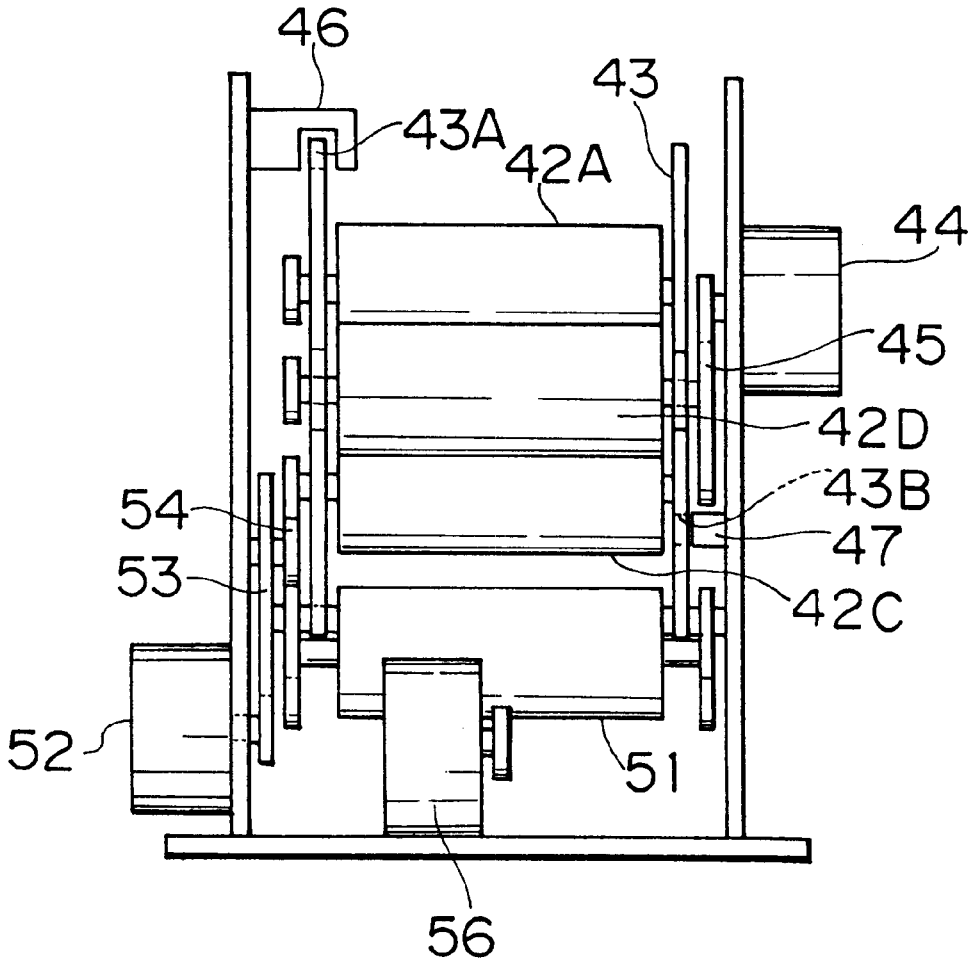
FIG. 3 is a side view illustrating the outline inner structure of the printing apparatus in FIG. 1.

FIGS. 2 and 3 are a front view and a side view, respectively, showing the outline inner structure of the printing apparatus in FIG. 1. As shown in FIGS. 2 and 3, the printing apparatus has a printing part 30 for printing an image on recording paper or roll paper 20, and a cutting part 40 for cutting the roll paper 20.

The roll paper 20 is used for producing peel-off stickers, and the roll paper 20 comprises sticker paper and backing paper on which the sticker paper is attached. Images are printed on the sticker paper. The sticker paper is coated with the following heat-sensitive color developing layers: a yellow layer, a magenta layer and a cyan layer. The roll paper 20 is pinched between capstan rollers 24 & 25 and pinch rollers 26 & 27, which face to the capstan rollers 24 & 25, respectively. A motor 21 applies a rotational driving force to the capstan rollers 24 & 25 through belts 22 & 23. The roll paper 20 is transported horizontally in FIG. 2 with the rotation of the capstan rollers 24 & 25. Reference numeral 28 is a photo-reflector for determining a printing position by detecting the leading end of the roll paper 20.

The printing part 30 comprises a thermal head 32 arranged in a manner to face a platen roller 31 across the roll paper 20, and fixing lamps 33 & 34, which fix the magenta and yellow colors on the roll paper 20.

To print a color image on the roll paper 20 on the printing part 30, the roll paper 20 is transported until the photo-reflector 28 detects the leading end of the roll paper 20 (a printing start position). Upon detecting, the roll paper 20 is transported on the capstan roller 24 and the pinch roller 26 at a constant speed to the right in FIG. 2, while the thermal head 32 is controlled to generate heat within a range of thermal energy with which the yellow layer on the roll paper 20 develops color so that the yellow layer can have a color developing density corresponding to the color image. The fixing lamp 33 irradiates a light of which central wavelength is 425nm onto the roll paper 20 in order to fix the yellow color on the roll paper 20. Then, the roll paper 20 is rewound to the printing start position, and it is transported to the right in FIG. 2 at a constant speed, while the thermal head 32 is controlled to generate heat within a range of thermal energy with which the magenta layer on the roll paper 20 develops color so that the magenta layer can have a color developing density corresponding to the color image. The fixing lamp 34 irradiates a light of which central wavelength is 365 nm onto the roll paper 20 in order to fix the magenta color on the roll paper 20. Then, the roll paper 20 is rewound to the printing start position, and it is transported to the right in FIG. 2 at a constant speed, while the thermal head 32 is controlled to generate heat within a range of thermal energy with which the cyan layer on the roll paper 20 develops color so that the cyan layer can have a color developing density corresponding to the color image. The color image is thereby printed on the roll paper 20.

The cutting part 40 comprises a cutter interchanging part, a punching part, which leaves the backing paper of the roll paper 20 uncut while cutting only the sticker paper on which the image is printed (this cutting will be hereunder referred to as half-cutting), and a full-cutting part, which cuts the roll paper 20 by a predetermined length by cutting both the sticker paper and the backing paper.

The cutter interchanging part has a cutter assembly wheel 43 (see FIG. 4), by which four types of cutter rollers 42A–42D are held. A motor 44 rotates the cutter assembly wheel 43 through a belt 45 to move a desired one of the cutter rollers 42A–42D to a predetermined using position (which faces to an opposite roller 51 in FIG. 2). As shown in FIG. 3, a photo-interrupter 46 detects a concave part 43A of the cutter assembly wheel 43 to position one of the cutter rollers 42A–42D at the opposite side of the opposite roller 51.

Figure 5:
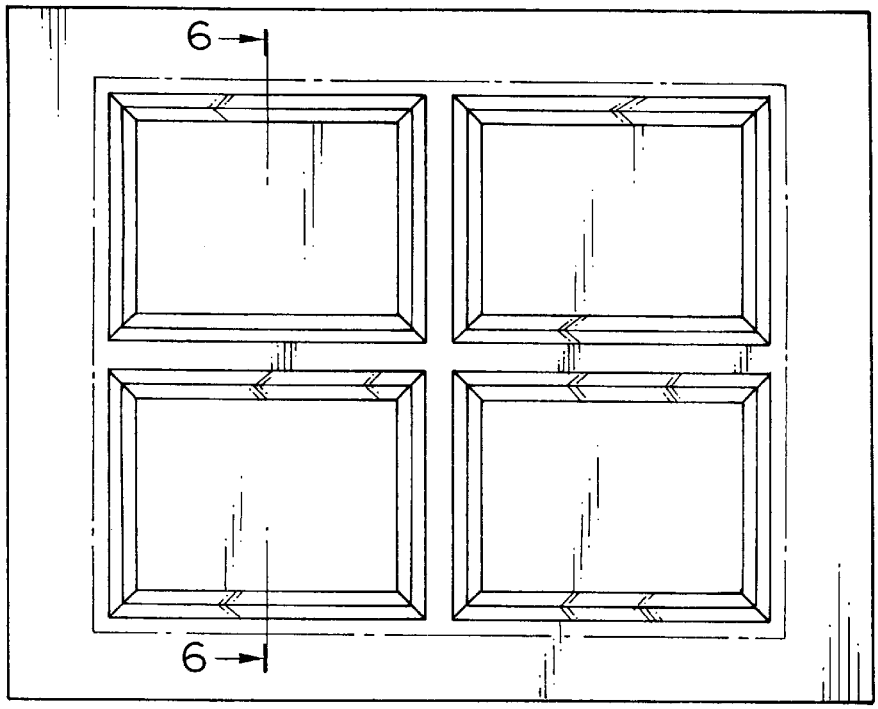
FIG. 5 is a view illustrating a development of the circumferential surface of a cutter roller, which has the first cutting pattern.
Figure 6:
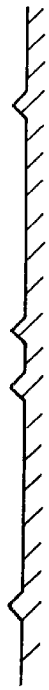
FIG. 6 is a sectional view taken along line 6—6 in FIG. 5.
Figure 7:
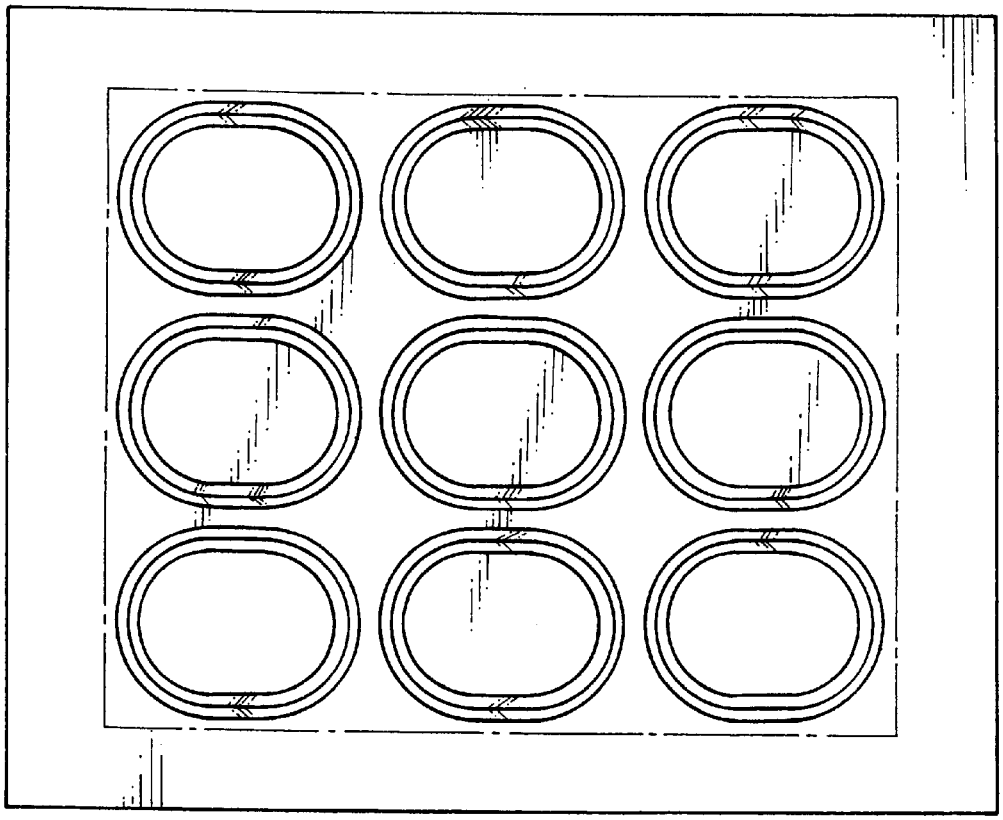
FIG. 7 is a view illustrating a development of the circumferential surface of a cutter roller, which has the second cutting pattern.
Figure 8:
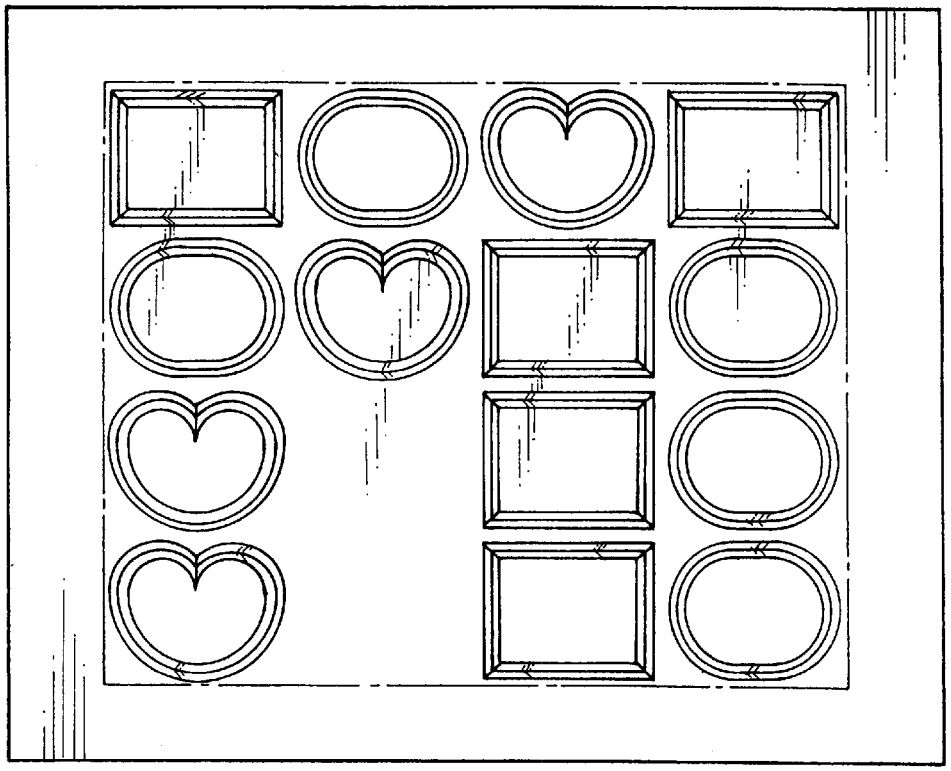
FIG. 8 is a view illustrating a development of the circumferential surface of a cutter roller, which has the third cutting pattern.
Figure 11:
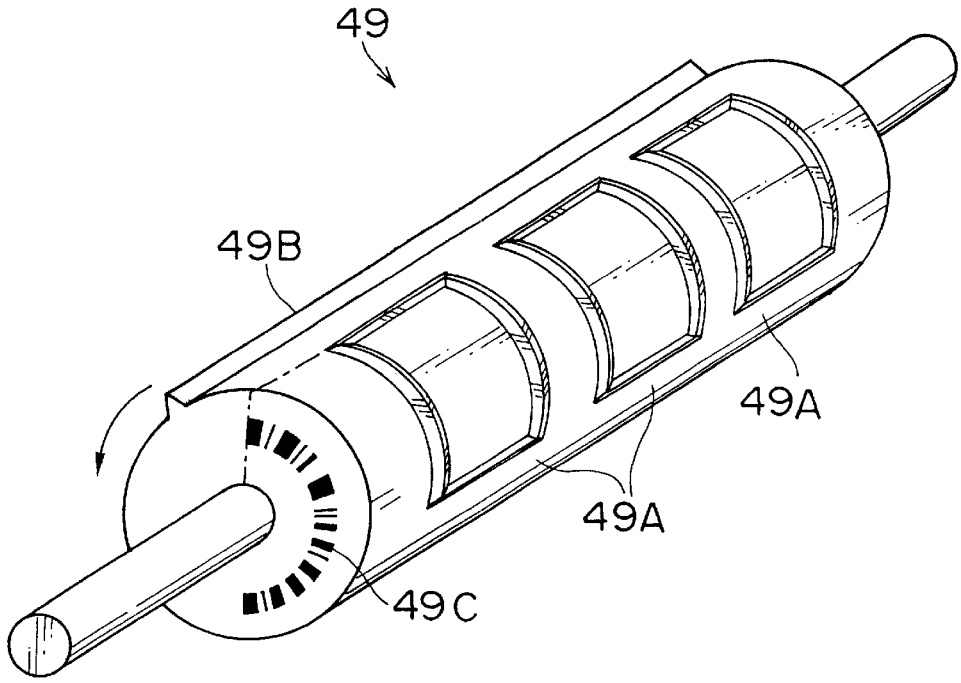
FIG. 11 is a perspective view illustrating another embodiment of a cutter roller.

The cutter rollers 42A–42D are provided with punching dies corresponding to cutting patterns (layouts) on the circumferential surfaces thereof (see FIG. 11). FIG. 5 is a development of the circumferential surface of one of the cutter rollers, and FIG. 6 is a sectional view taken along line 6—6 in FIG. 5. In the first cutting pattern of the cutter roller in FIG. 5, the number of image splits and the number of images are four, and the punching shape of each image is "square".

FIGS. 7–10 are developments of the circumferential surfaces of other cutter rollers that have different cutting patterns from the cutting pattern of the cutter roller in FIG. 5. In the second cutting pattern of the cutter roller in FIG. 7, the number of image splits and the number of images are nine and the punching shape of each image is "oval". In the third cutting pattern of the cutter roller in FIG. 8, the number of image splits and the number of images are sixteen, and the punching shapes of the images are "nothing", "heart", "oval" and "square". "Nothing" means that the outer form of the image is not cut. The outer form of the image in the "nothing" area remains uncut. Thus, the user can cut the outer form of the uncut image to a desired form with a pair of scissors.

Figure 9:
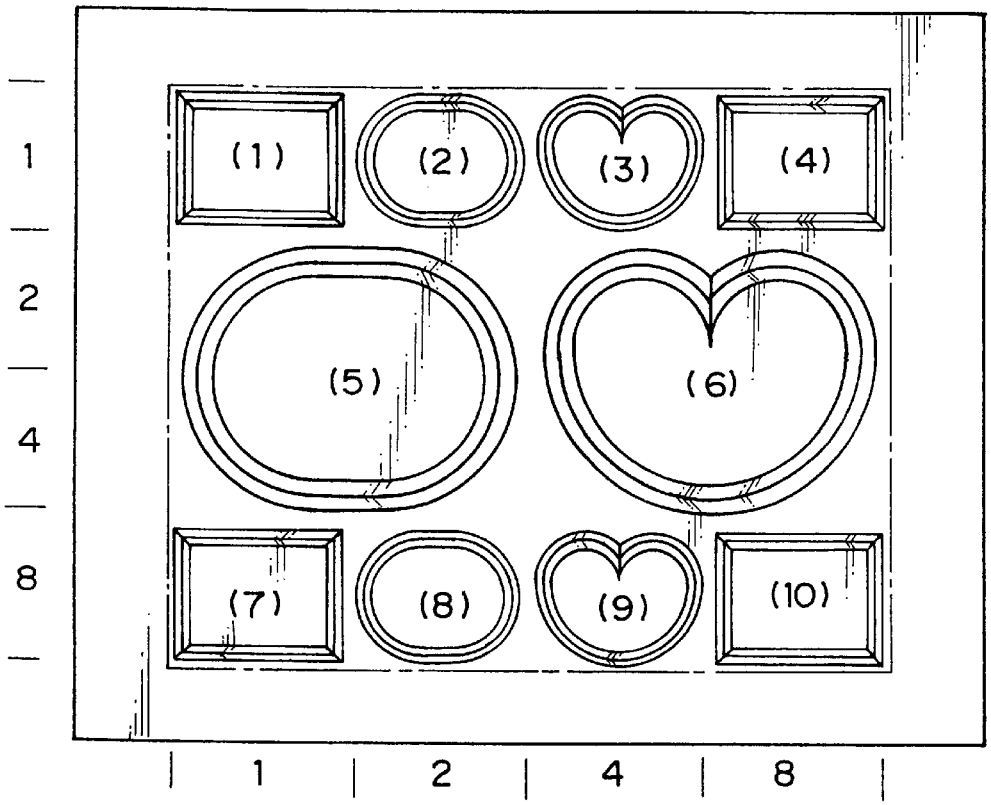
FIG. 9 is a view illustrating a development of the circumferential surface of a cutter roller, which has the fourth cutting pattern.
Figure 10:
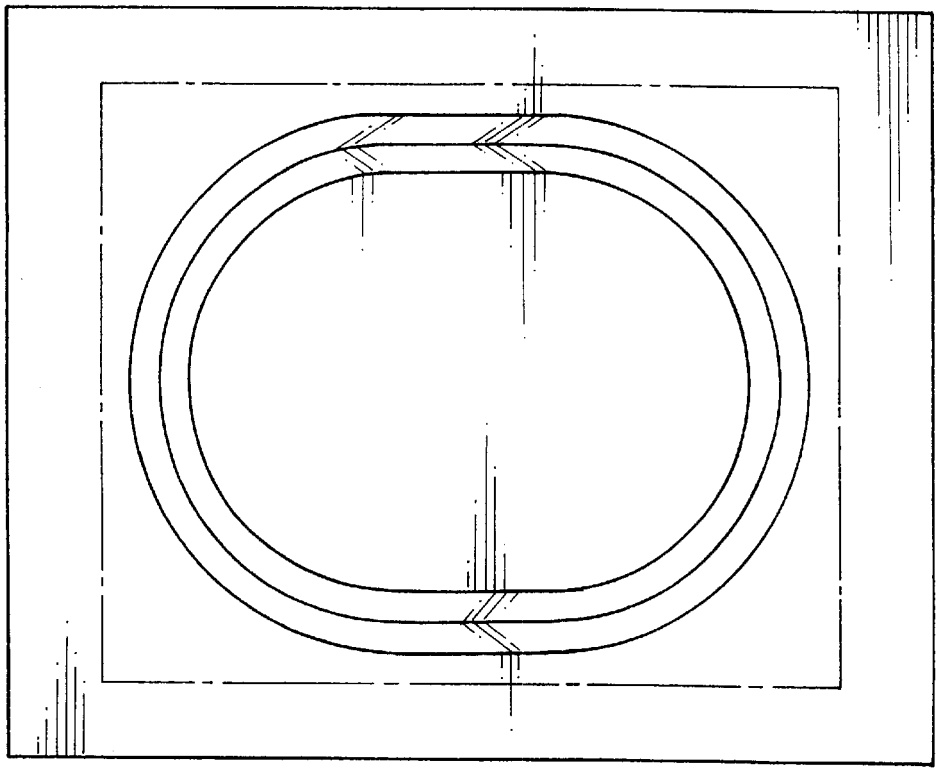
FIG. 10 is a view illustrating a development of the circumferential surface of a cutter roller, which has the fifth cutting pattern.

In the fourth cutting pattern of the cutter roller in FIG. 9, the number of images splits is sixteen, and the number of images is ten. The punching shapes of the images are "heart", "oval" and "square". There are two sizes of the "heart" and "oval" shapes. In the fifth cutting pattern of the cutter roller in FIG. 10, the number of image splits and the number of images are one, and the punching shape of the image is "oval". In FIGS. 7–10, a printing area is indicated by long and short alternative lines.

A description will be given of barcode information indicating the cutting patterns of the cutter rollers. A relationship between the number of image splits, the number of images and the punching shapes and codes are shown on TABLE 1.

TABLE 1

| | Code |
|---|---|
| The number of image splits | |
| 1 | 0 |
| 4 | 1 |
| 9 | 2 |
| 16 | 3 |
| 25 | 4 |
| 36 | 5 |
| 49 | 6 |
| 64 | 7 |

TABLE 1-continued

| | Code |
|---|---|
| The number of images | |
| 1 | 0 |
| 2 | 1 |
| 3 | 2 |
| 4 | 3 |
| . | . |
| . | . |
| . | . |
| 64 | 3F |
| Punching shape | |
| Nothing | 0 |
| Heart | 1 |
| Oval | 2 |
| Square | 3 |
| — | 4 |
| — | 5 |
| — | 6 |
| — | 7 |

In TABLE 1, the number of image splits means grids of 1×1, 2×2, 3×3, . . . , 8×8. For example, in the case of the cutting pattern of the cutter roller in FIG. 9, the number of image splits is 16, which means the grids of 4×4.

A description will be given of codes indicating the position and size of each image.

In the case of the cutting pattern of the cutter roller in FIG. 9, the grids of 4×4 is the reference size. The position of the punching die (1) is indicated as [0101], and the punching die (9) is indicated as [0804]. The size and position of the punching die (5) are indicated as [0603]. The punching die (5) extends over two grids horizontally and vertically. [06] is the sum of the vertical grids [02] and [04], and [03] is the sum of the horizontal grids [01] and [02]. The code of the punching shape as shown in TABLE 1 is added to the head. Hence, the punching die (1) is indicated as [030101], the punching die (5) is indicated as [020603], and the punching die (9) is indicated as [010804].

Thus, the cutting pattern of the cutter roller in FIG. 9 is indicated by the barcode [03] indicating the number of image splits; the barcode [09] indicating the number of images; the barcodes [030101], [020102], [030108], [020603], [01060C], [030801], [020802], [010804] and [0308081] indicating the punching shapes, positions and sizes of ten punching dies (1)–(10).

Figure 4:
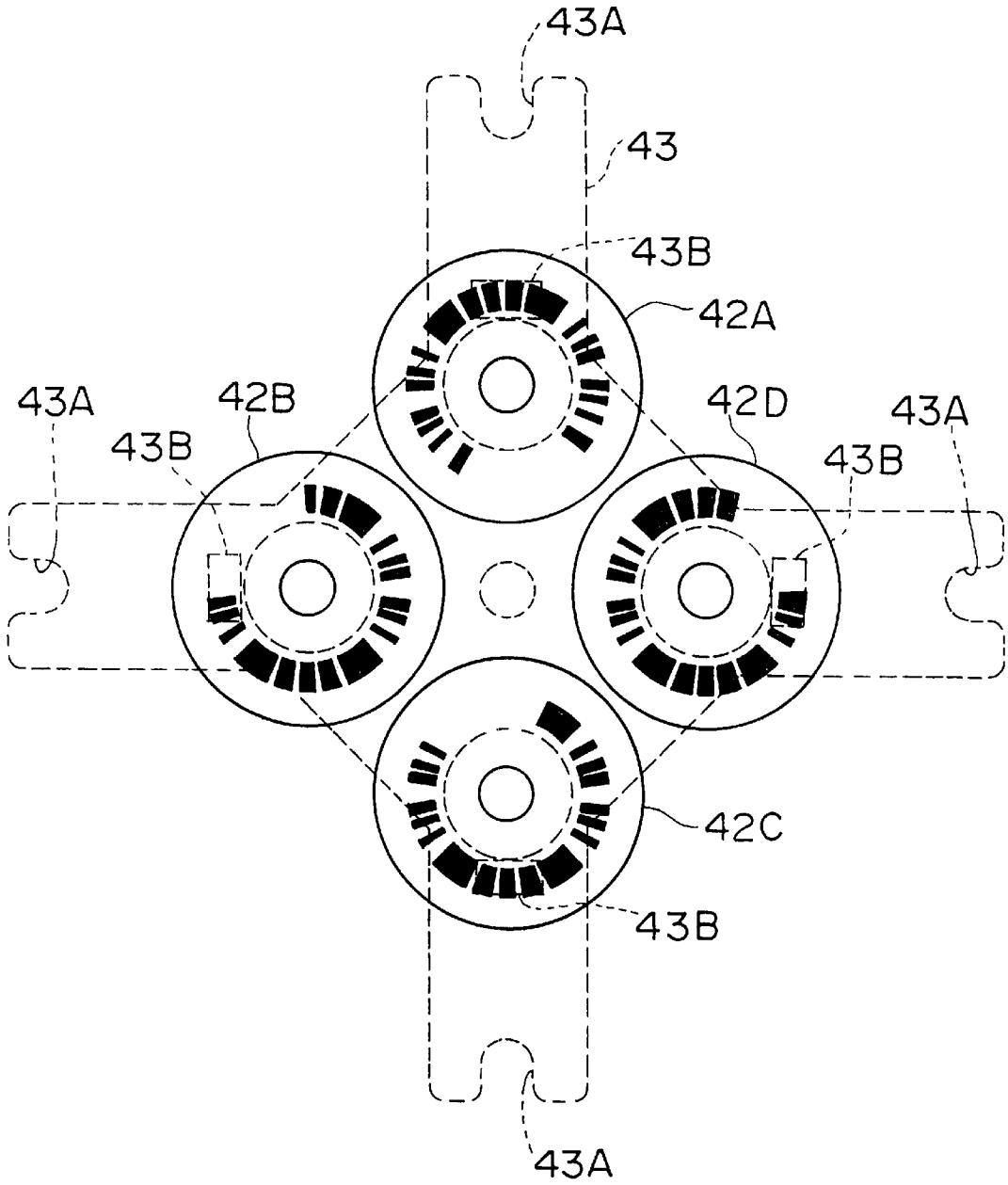
FIG. 4 is an enlarged view illustrating a cutter assembly wheel in FIG. 2.

The barcodes indicating the cutting patterns of the cutter rollers are provided at the sides of the cutter rollers 42A–42D as shown in FIG. 4.

As shown in FIGS. 2 and 3, a motor 52 drives the cutter roller that is positioned at the using position through a belt 53 and a roller 54. A barcode reader 47 reads the barcode provided at the rotated cutter roller through an opening 43B formed at the cutter assembly wheel 43 as shown in FIG. 3. Thus, the printing apparatus can recognize where the cutter roller with what cutting pattern is held in the cutter assembly wheel 43.

To half-cut the outer form of the image printed on the roll paper 20 by the cutter roller positioned at the using position, the opposite roller 52 opposite to the cutter roller is lifted to a predetermined position. Specifically, the opposite roller 51 is mounted on a lever 55 as shown in FIG. 2, and a motor 56 transmits a vertical driving force to one end of the lever 55 through a belt 57 and a pin 58A of a belt wheel 58. Consequently, the opposite roller 51 mounted on the lever 55 is lifted to the predetermined cutting position represented with a solid line in FIG. 2, and is retreated to a retreating position represented with a broken line. A gap, which is equal to the thickness of the backing paper of the roll paper 20, is formed between the punching die of the cutter roller positioned at the using position and the opposite roller 51 lifted to the cutting position. Therefore, only the sticker paper is cut on the roll paper 20.

In FIG. 2, the roll paper 20, on which the outer form of the image is half-cut by the cutter roller, is transported to the right, and the roll paper 20 is stopped when a cut-off position of the roll paper 20 reaches a cutting position of a cutter 48,. The cutter 48 moves in a direction perpendicular to the transport direction of the roll paper 20, and full-cuts off a portion of the recording paper on which the image is printed and the outer-form of the image is punched, from the roll paper 20. The cut-off recording paper is ejected to the paper exit tray 19 (see FIG. 1), and the roll paper 20 is rewound until the photo-reflector 28 detects the leading end of the roll paper 20.

FIG. 11 is a perspective view illustrating another embodiment of a cutter roller. Punching dies 49A corresponding to the cutting pattern are formed on a circumferential surface of the cutter roller 49, and a cutting edge 49B is formed along the generatrix of the circumferential surface. The cutter roller 49 can half-cut the roll paper 20 with the punching dies 49A, and full-cut off the recording paper from the roll paper 20 with the cutting edge 49B. This eliminates the necessity for the cutter 48 for full-cutting.

A barcode 49C is formed at the side of the cutter roller 49 in a predetermined phase relationship with the punching dies 49A. Specifically, a recording start position or a leading end of the barcode 49C is aligned with the leading ends of the punching dies 49A, or is off by a predetermined degree from the leading ends of the punching dies 49A. Hence, it is possible to determine the phase of the cutter roller 49 by detecting the leading end of the barcode 49C with the barcode reader 47.

Figure 12:
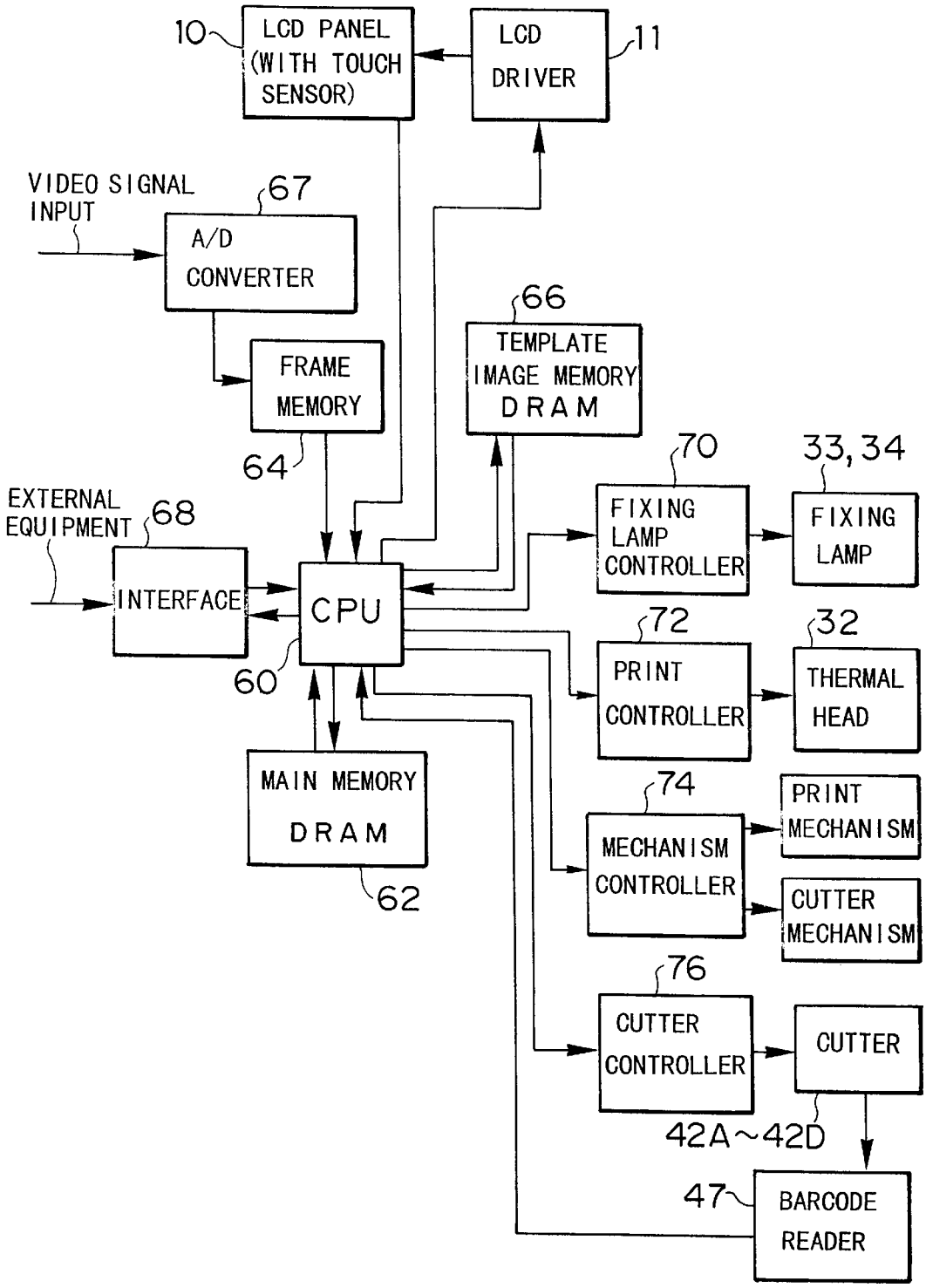
FIG. 12 is a block diagram illustrating the inner structure of the printing apparatus.

FIG. 12 is a block diagram illustrating the inner structure of the embodiment of the printing apparatus.

As shown in FIG. 12, the printing apparatus comprises the LCD panel 10 (see FIG. 1), a central processing unit (CPU) 60, a main memory 62 such as a dynamic random access memory (DRAM), a frame memory 64, a template image memory 66 such as a DRAM, the printing part 30 and the cutting part 40, which were described in detail with reference to FIGS. 2 and 3, and a variety of controllers for controlling the printing part 30 and the cutting part 40: a fixing lamp controller 70, a print controller 72, a mechanism controller 74, and a cutter controller 76.

The printing apparatus captures a video signal through the video signal input terminal 14 in FIG. 1. The captured video signal is converted into digital image data by an AID converter 67. The converted image data is temporally stored in the frame memory 64, and is then stored in the main memory 62. The printing apparatus also captures image data from the external equipment through the parallel terminal 16 (see FIG. 1) and an interface 68. The captured image data is stored in the main memory 62. The main memory 62 has an area where the captured image data of one frame is stored, a processing area where the input image and the template image are combined, a printing area in which the composed data is stored, a displaying area where the image data representing an image to be displayed on the LCD panel 10 is stored, etc.

The LCD driver 11 drives the LCD panel 10 in accordance with the image data representing the image to be displayed on the LCD panel 10 stored in the main memory 62, so that a later-described variety of template images, the cutting patterns, the composite images composed from the captured image and the template image, etc. can be displayed on the LCD panel 10. The buttons and the scroll bars are displayed on the screen of the LCD panel 10 so as to enable the user to enter commands by touching the touch sensor over the screen of the LCD panel 10. This will be described later in further detail.

The CPU 60 connects to the memories 62, 64 & 66, the controllers 70, 72 & 76, and the interface 68. The CPU 60 supervises the components in accordance with the inputs from the touch sensor, etc.

A description will be given of the setup of the printing apparatus.

Figure 13:
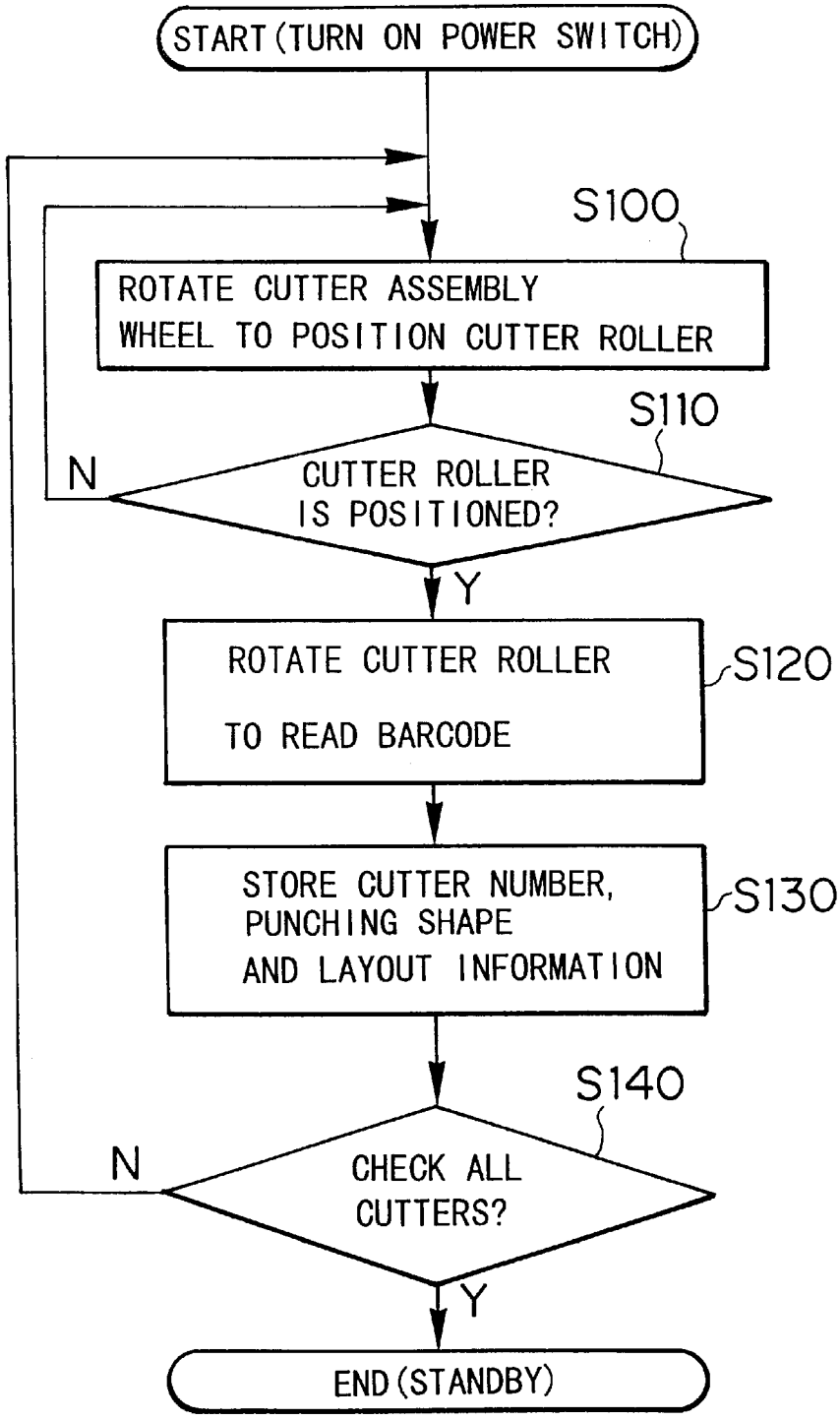
FIG. 13 is a flow chart of assistance in explaining the setup in the printing apparatus.

FIG. 13 is a flow chart showing the setup procedure of the printing apparatus. As shown in FIG. 13, when the power switch 12 (see FIG. 1) is turned on, the cutter assembly wheel 43 is rotated to position one of the four cutter rollers to the predetermined using position (S100). When the positioning of the cutter roller is completed (Silo), the positioned cutter roller is rotated so that the barcode reader 47 can read the barcode formed at the side of the cutter roller (S120).

Figure 14:
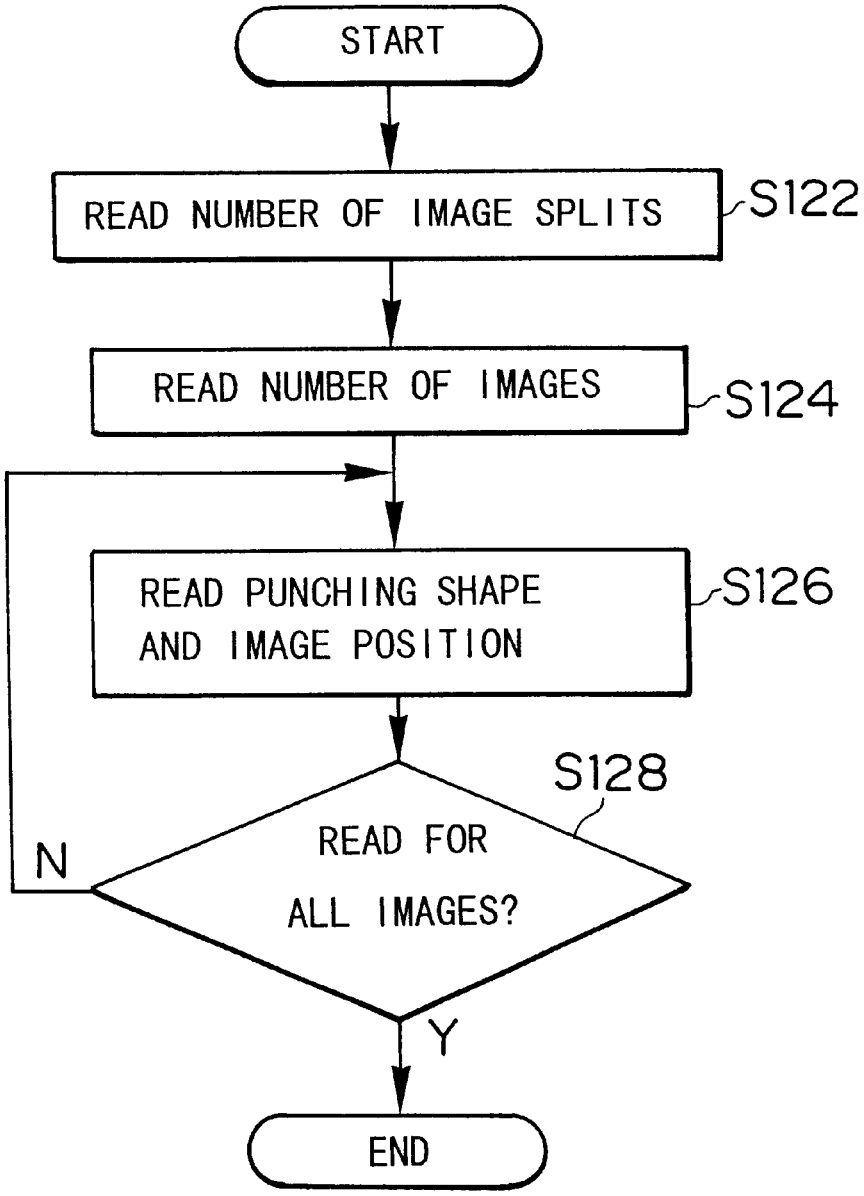
FIG. 14 is a flow chart of assistance in explaining the state wherein barcode information representing the cutting pattern of a cutter roller is read.

As shown in FIG. 14, the number of image splits and the number of images are read (see Table 1) (S122 and S124). Then, the punching shape and position of each image are read (S126). After the punching shapes and positions of all images are read (S128), the reading is completed.

The read information representing the cutting pattern (layout of the cut images) of the cutter roller is stored in association with a cutter number of the cutter (the held position on the cutter assembly wheel 43) (S130 in FIG. 13).

Then, whether the cutting pattern has already been checked with respect to all cutter rollers held by the cutter assembly wheel 43 (S140). If the checking is incomplete, the procedure returns to S100 so that S100–S130 can be repeated. On completion of the checking, the setup is finished and the standby state starts. The setup makes it possible for the printing apparatus to recognize where the cutter roller with what cutting pattern is held by the cutter assembly wheel 43.

A description will be given of a method of the image printing and cutting method according to an embodiment of the present invention.

Figure 15:
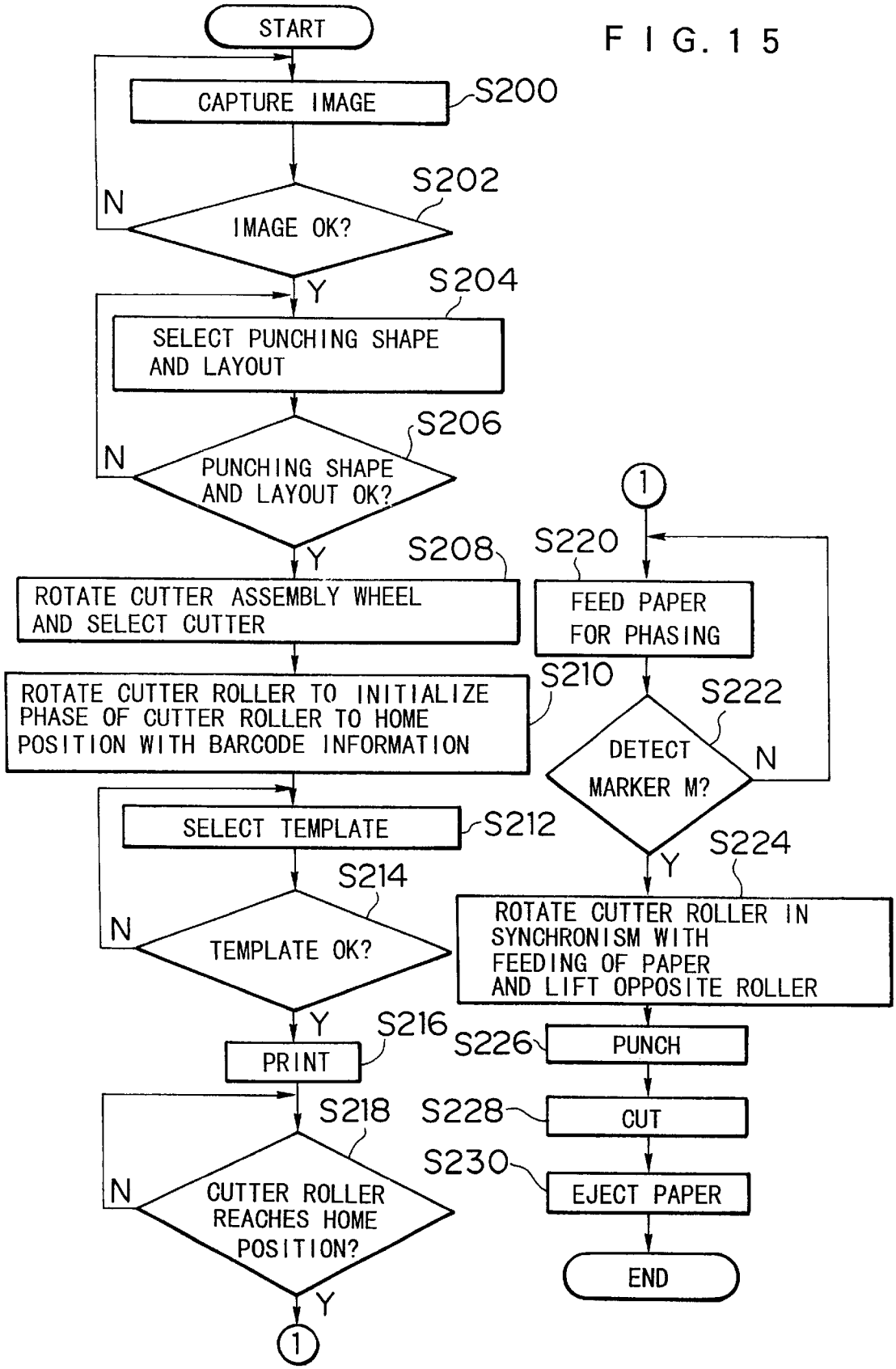
FIG. 15 is a flow chart illustrating an embodiment of an image printing and cutting method according to the present invention.

FIG. 15 is a flow chart showing the embodiment of the present invention. As shown in FIG. 15, the image data of the image to be printed is captured (S200). The image data is captured through the video signal input terminal 14 in FIG. 1 or the parallel terminal 16 connected to the external equipment such as the scanner, or is read from the external recording medium such as the floppy disk and the memory card. In accordance with the captured image data, the image is displayed on the LCD panel 10, and an instruction is required as to whether to print the displayed image (S202). If the image displayed on the LCD panel 10 is not printed, an instruction is given to capture the image data of another image. If the image displayed on the LCD panel 10 is printed, an OK button on the screen is touched to advance to S204.

Figure 16:
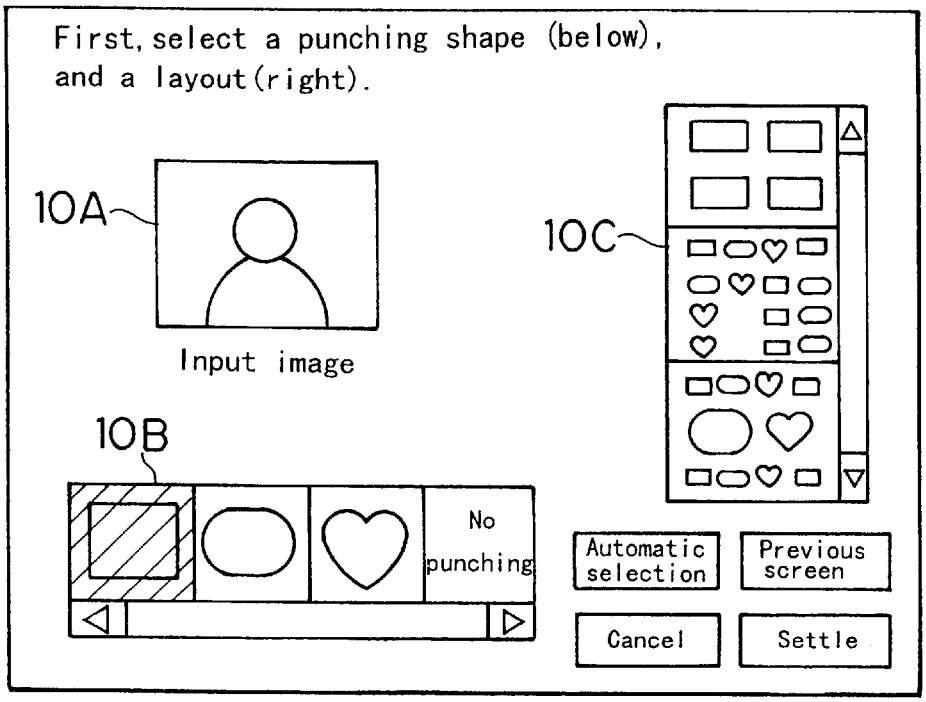
FIG. 16 is a view illustrating a screen of an LCD panel for selecting a punching shape and a layout.

At S204, the punching shape of the outer form and the layout of the captured image are selected. At S204, a screen in FIG. 16 is displayed on the LCD panel 10. The captured image is shown on a display part 10A, a plurality of punching shapes are shown on a display part 10B, and a plurality of layouts are shown on a display part 10C. The punching shapes on the display part 10B and the layouts on the display part 10C are represented as selectable buttons. A variety of buttons are displayed at the lower right corner of the screen.

The punching shape and the layout are selected by means of the screen of the LCD panel 10 (S204 and S206). Specifically, a desired punching shape is touched among the plurality of punching shapes shown on the display part 10B to select the punching shape. The selected punching shape changes its color, in brightness, etc. on the screen so that the user can recognize the selection. If there is no desired punching shape among the plurality of punching shapes shown on the display part 10B, an arrow of a horizontal scroll bar under the display part 10B is touched to thereby scroll the punching shapes shown on the display part 10B.

Upon selection of the punching shape, the layouts that include the selected punching shape are shown on the display part 10C. In FIG. 16, a square punching shape is selected, and thus a plurality of layouts including the square punching shape are shown on the display part 10C.

Then, a desired layout is touched among the plurality of layouts shown on the display part 10C of the LCD panel 10 to select the layout. The selected layout changes its color, etc. on the screen so that the user can recognize the selection. If there is no desired layout among the plurality of layouts shown on the display part 10C, an arrow of a vertical scroll bar at the left of the display part 10C is touched to thereby scroll the layouts shown on the display part 10C. The layout may be selected directly without selecting the punching shape.

Incidentally, the number of cutter rollers selected from the cutter assembly wheel 43 corresponds to the number of layouts. In this embodiment, four cutter rollers are mounted on the cutter assembly wheel 43, and thus a desired layout is selected among four layouts. If a number of cutter rollers mounted on the cutter assembly wheel were increased, selectable layouts would be increased.

After the punching shape and the layout are selected in the above-mentioned manner, the cutter assembly wheel 43 is rotated to position the cutter roller that provides the selected layout at the predetermined using position (S208). Then, the positioned cutter roller is rotated until the leading end of the barcode (see FIG. 11) of the cutter roller is detected so that the reference position of the cutter roller can be at a predetermined home position (S210).

Figure 17:
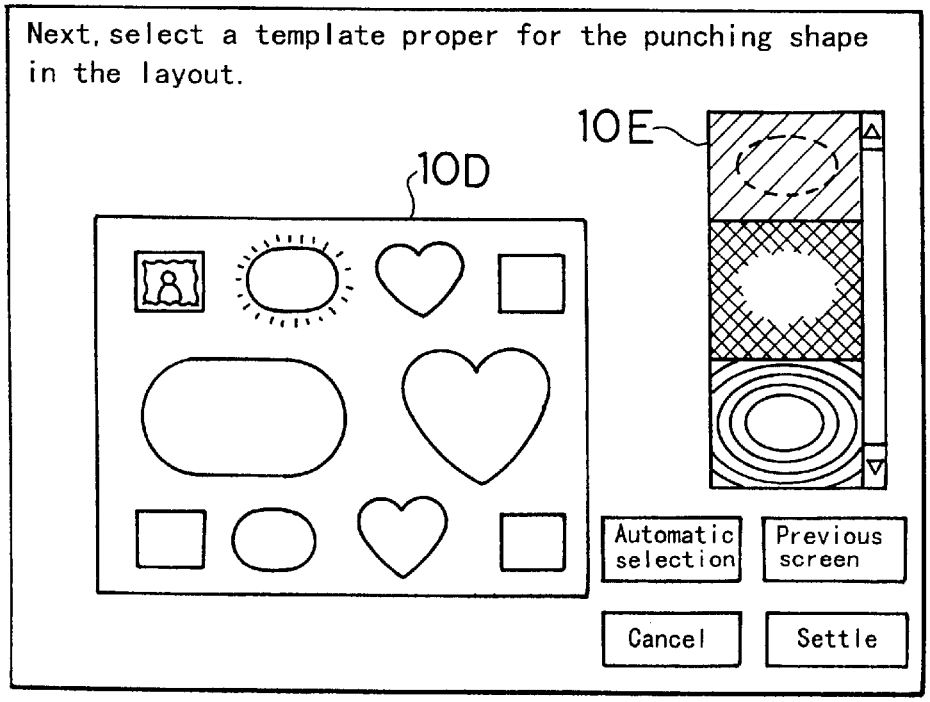
FIG. 17 is a view illustrating a screen of the LCD panel for selecting a template image proper for the punching shape in the layout.

Then, a template image is selected (S212 and S214). After the layout is selected in the above-mentioned manner, the screen in FIG. 17 is displayed on the LCD panel 10. As shown in FIG. 17, the selected layout is shown on a display part 10D on the LCD panel 10, and a plurality of template images are shown on a display part 10E. The plurality of template images at the display part 10E are represented as selectable buttons, and a variety of buttons are displayed at the lower right of the screen.

FIG. 17 shows the selection of a template image proper for the second punching shape in the second column on the first line. This punching shape is blinking. Since the punching shape is an oval, a plurality of template images proper for the oval is shown on the display part 10E. A desired template image is touched among the plurality of template images shown on the display part 10E to select the template image. When the template image for the second punching shape is selected, the selected template image and the captured image are combined into a composite image. The composite image is put into the punching shape, and the screen is switched for selecting the third template image. Since the third punching shape is a heart, a plurality of template images proper for the heart is shown on the display part 10E.

After the template images for all the punching shapes are selected in the above-mentioned manner, the image data representing a print image to be printed is created. The template images are not necessarily selected for all the punching shapes.

Figure 18:
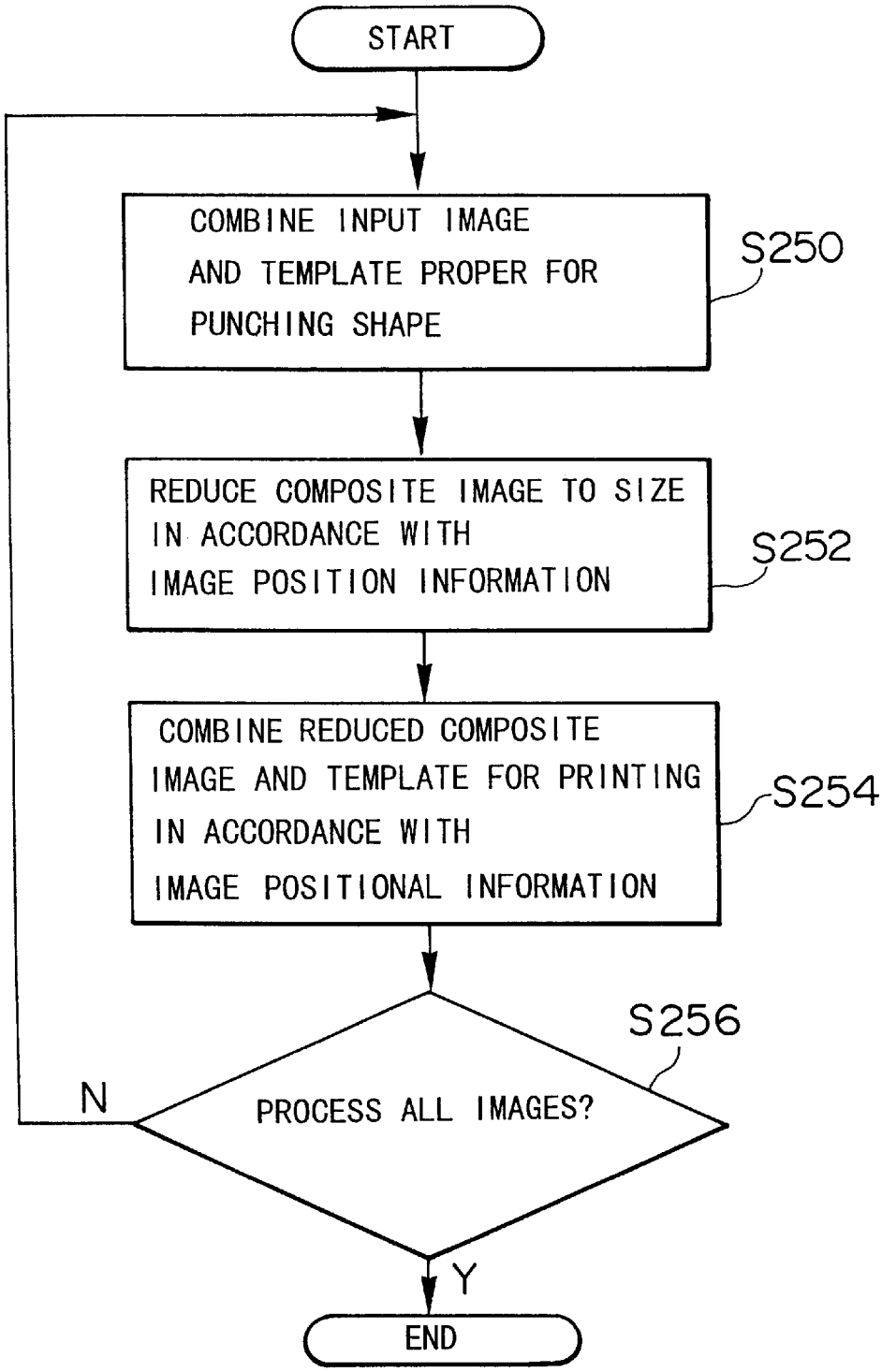
FIG. 18 is a flow chart showing the procedure for creating image data representing a printed image.
Figure 19:
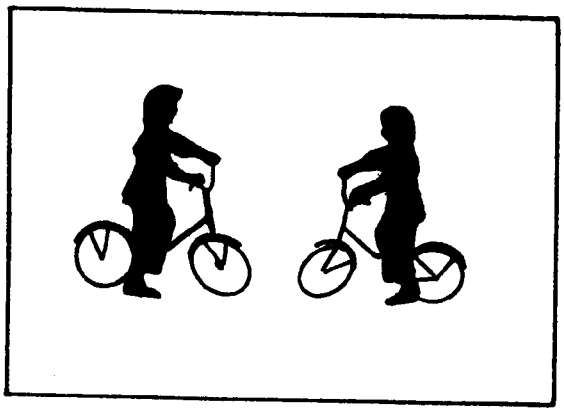
FIG. 19 is a view illustrating an example of a captured image.
Figure 20:
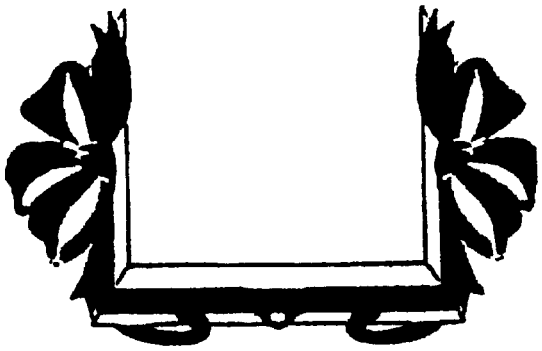
FIGS. 20(A), 20(B) and 20(C) are views illustrating examples of template images.
Figure 20:
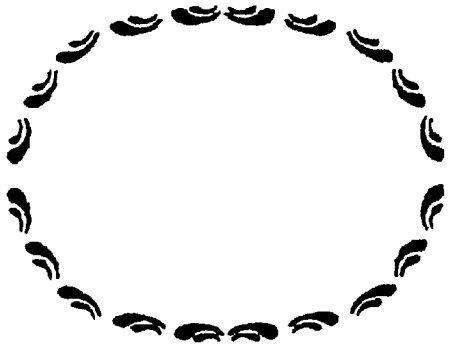
Figure 20:
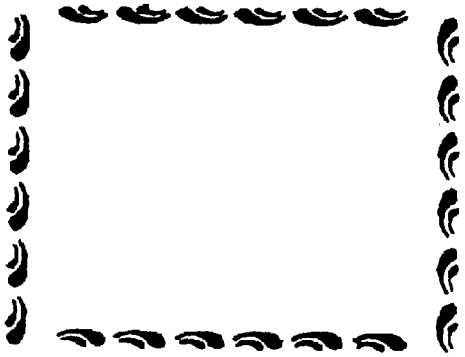
Figure 21:
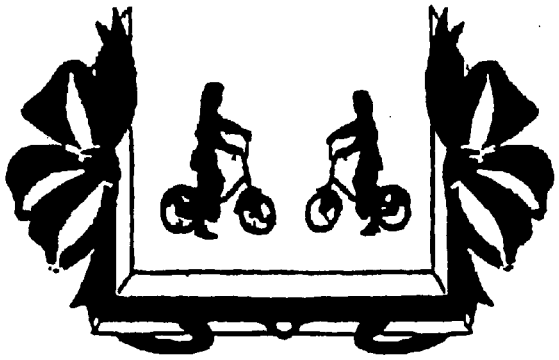
FIGS. 21(A), 21(B) and 21(C) are views illustrating images composed from the captured image shown in FIG. 19 and the template images shown in FIGS. 20(A), 20(B) and 20(C), respectively.
Figure 21:
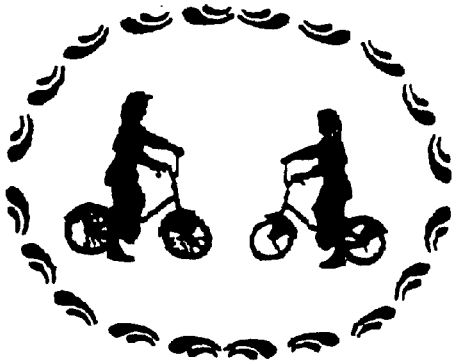
Figure 21:
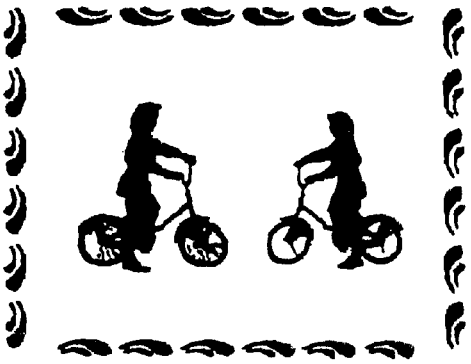

As shown in a flow chart of FIG. 18, to create the image data representing the print image, the captured image and the template image are combined (S250). If an image shown in FIG. 19 is the captured image and images shown in FIGS. 20(A), 20(B) and 20(C) are the template images, the composite images are composed as shown in FIGS. 21(A), 21(B) and 21(C).

The composite image is reduced to a size corresponding to the punching shape in which the composed image is put (S252), and the reduced composite image is combined at a proper position in the template for printing (the template corresponding to the punching pattern) in accordance with information about the position of the composite image (S254). On completion of the processing at S250–S254 with respect to all captured images, the creation of the image data representing the print image is finished (S256).

Figure 22:
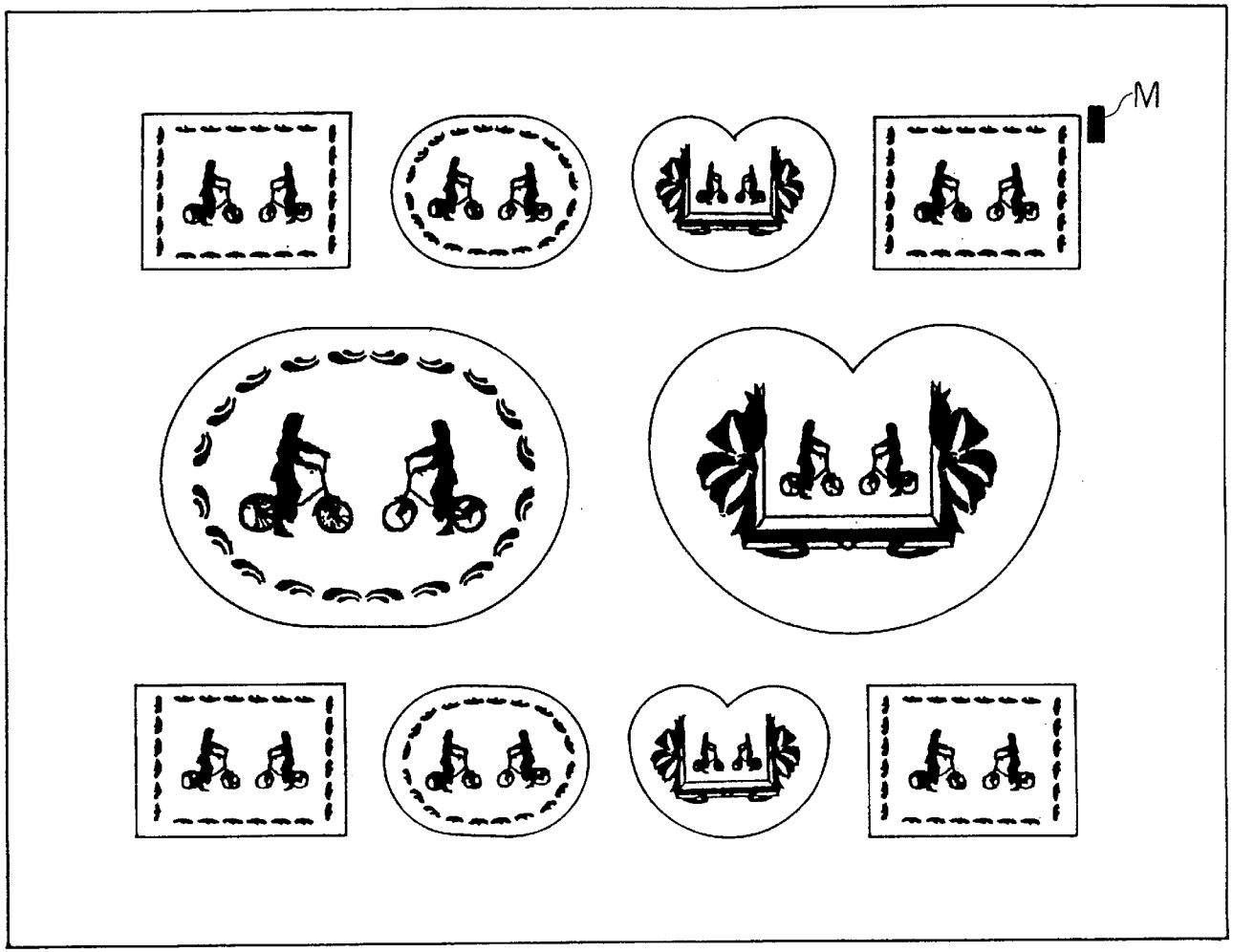
FIG. 22 is a view showing an example of the printed image.

FIG. 22 shows an example of the print image created in the above-mentioned manner. The image data representing the print image is stored in the area for printing in the main memory 62.

After the creation of the image data representing the print image, the procedure goes to S216 in FIG. 15, and the created print image is printed on the roll paper 20 in accordance with the image data representing the print image stored in the area for printing in the main memory 62. An indicator M for phasing the paper with the cutter roller is printed at the same time as the image (see FIG. 22).

After the image is printed on the roll paper 20, whether the reference position of the cutter roller has reached the preset home position or not is determined (S218). If the reference position of the cutter roller is at the preset home position, the paper is fed to be phased with the cutter roller (S220), and whether the photo-reflector 28 has detected the indicator M or not is determined (S222). The photo-reflector 28 detects the leading end of the roll paper 20 as the printing start reference position at the time of printing, and also operates as a sensor that detects the indicator M, which is the reference for punching, when the outer form of the printed image is punched.

When the photo-reflector 28 detects the indicator M (or the paper is fed by a predetermined length), the cutter roller is rotated in synchronism with the feeding of the paper, and the opposite roller 51 in FIG. 2 is lifted to the predetermined position (S224). When the cutter roller is rotated once, the outer forms of all the images printed on the roll paper 20 are punched (half-cut) (S226). The roll paper 20, in which the outer forms of the images are punched by the cutter roller, is transported to the right in FIG. 2 until the cut-off position of the roll paper 20 reaches the cutting position of the cutter 48. Then, the cutter 48 is moved in a direction perpendicular to the transport direction of the roll paper 20, and the recording paper is cut off from the roll paper 20 (S228). The cut-off recording paper is ejected on the paper exit tray 19 (see FIG. 1) (S230).

Figure 23:
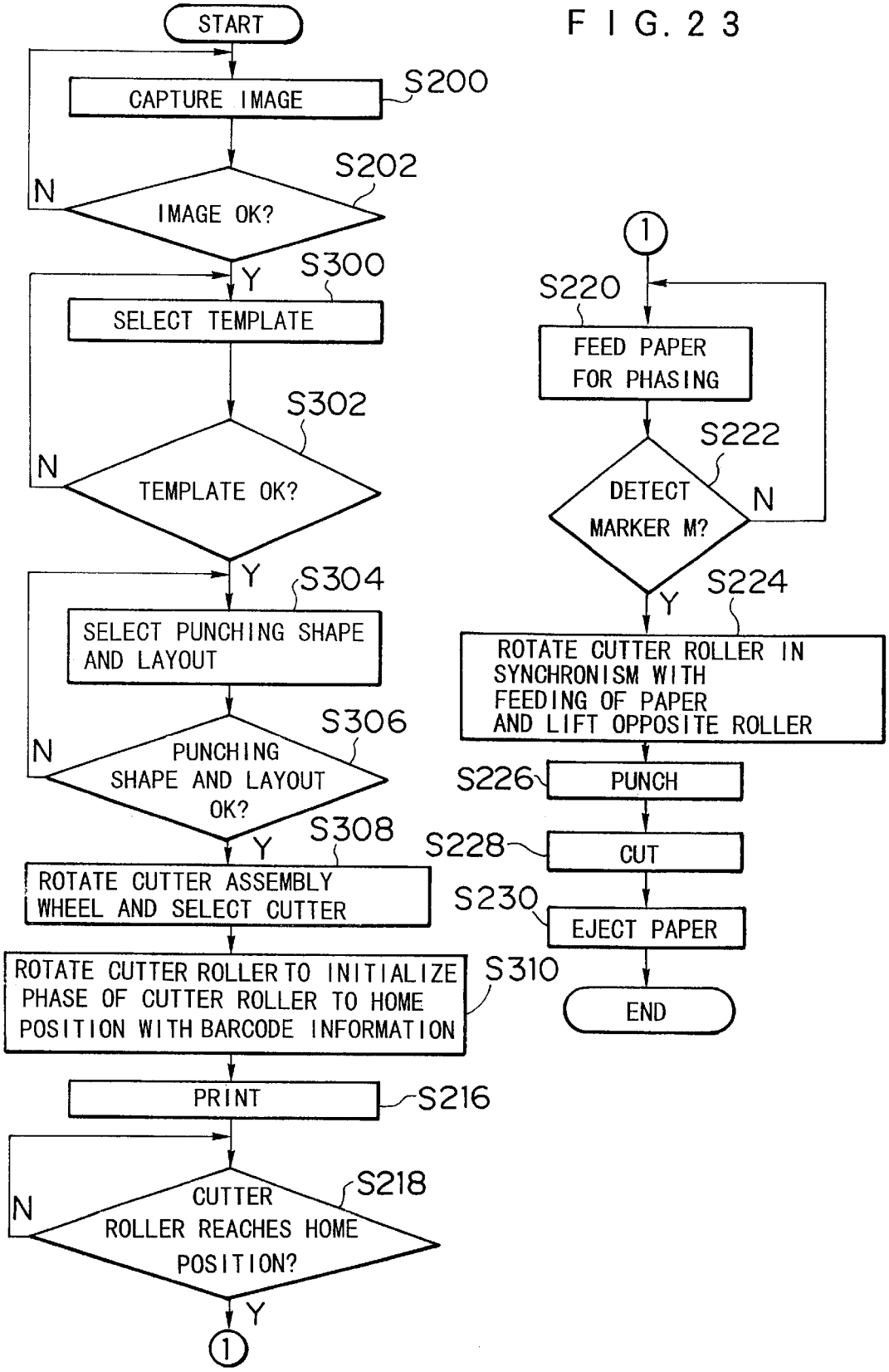
FIG. 23 is a flow chart showing another embodiment of the image printing and cutting method according to the present invention.

FIG. 23 is a flow chart showing another embodiment of the image printing and cutting method according to the present invention.

According to the flow chart of FIG. 15, the cutter roller (cutting layout) is selected first, and then the template images are selected. According to the flow chart of FIG. 23, the template images are selected first, and then the cutter roller is selected. Steps similar to those described with reference to the flow chart of FIG. 15 are denoted by the same reference numerals, and they will not be described in detail.

Figure 24:
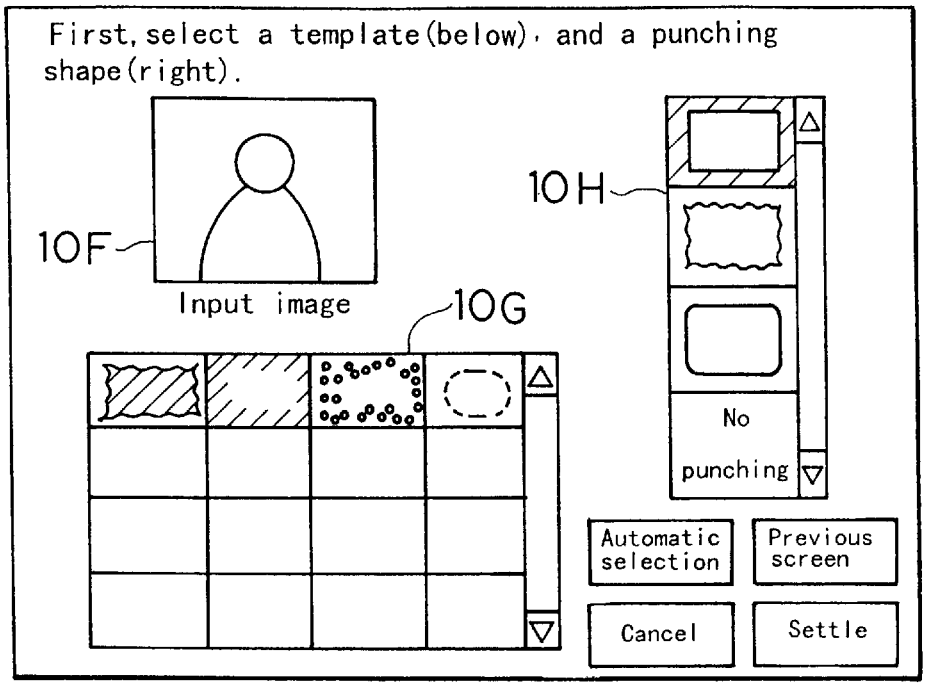
FIG. 24 is a view illustrating a screen of the LCD panel for selecting a template image and a punching shape.

After an image is captured at input S200 and S202, a template image to be combined with the captured image is selected (S300). Specifically, at the start of S300, a screen in FIG. 24 is shown on the LCD panel 10. As shown in FIG. 24, the captured image is shown on a display part 10F of the LCD panel 10, a plurality of template images are shown on a display part 10G, and a plurality of punching shapes are shown on a display part 10H. The plurality of template images at the display part 10G and the plurality of template images at the display part 10H are represented as selectable buttons, and a variety of buttons are displayed at the lower right of the screen.

The template image is selected on the screen of the LCD panel 10 (S300 and S302). Specifically, a desired template image is touched among the plurality of template images shown on the display part 10G of the LCD panel 10 to select the template image. The selected template image changes its color, in brightness, etc. on the screen so that the user can recognize the selection. If there is no desired template image among the plurality of template images shown on the display part 10G, an arrow of a vertical scroll bar at the right side of the display part 10G is touched to thereby scroll the template images shown on the display part 10G.

Then, a punching shape and a layout are selected (S304 and S306). Upon selection of the template image, the punching shapes proper for the template image are shown on the display part 10H. Since a template image with substantially a square outer form is selected in FIG. 24, substantially square punching shapes are shown on the display part 10H. A desired punching shape is touched among the plurality of punching shapes shown on the display part 10H to select the punching shape. The selected punching shape changes in brightness, etc. on the screen so that the user can recognize the selection. If there is no desired punching shape among the plurality of punching shapes shown on the display part 10H, an arrow of a vertical scroll bar at the right side of the display part 10H is touched to thereby scroll the punching shapes shown on the display part 10H.

Figure 25:
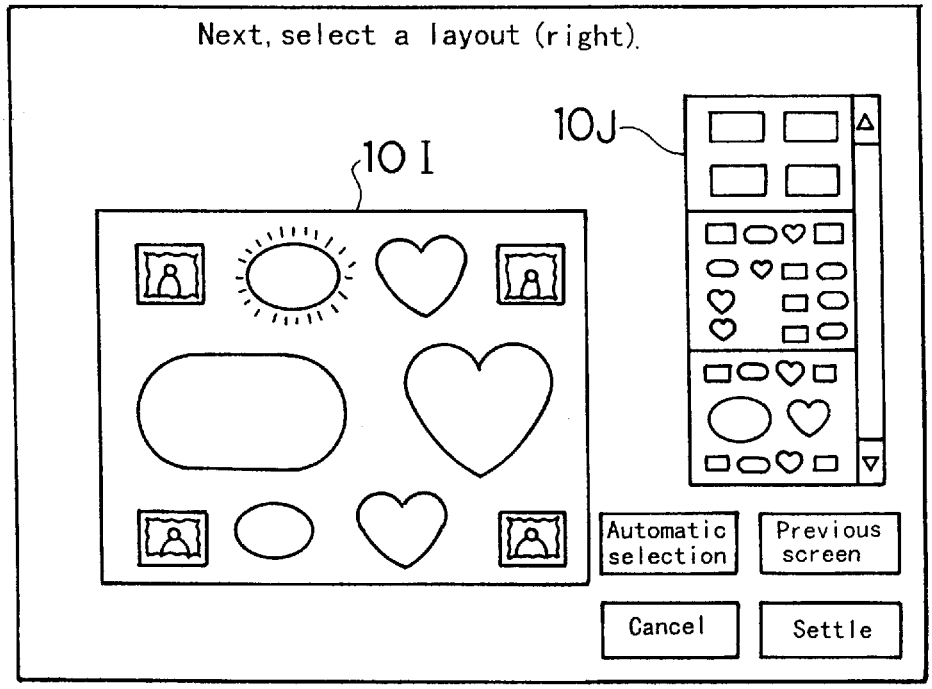
FIG. 25 is a view illustrating a screen of the LCD panel for selecting a layout.

Upon selection of the punching shape (the punching shape for the first image if there are a plurality of images to be printed), the layouts that include the selected punching shape are shown on a display part 10J of the LCD panel 10 as shown in FIG. 25. Since the square punching shape is selected, a plurality of layouts including the square punching shape are shown on the display part 10J.

A desired layout is touched among the plurality of layouts shown on the display part 10J to select the layout. The selected layout changes in brightness, etc., so that the selection can be recognized. If there is no desired layout among the plurality of layouts shown on the display part 10J, an arrow of a vertical scroll bar at the right side of the display part 10J is touched to thereby scroll the layouts shown on the display part 10J.

The selected layout is enlarged on a display part 101 of the LCD panel 10, and a composite image of the captured image and the selected template image is combined with the selected punching shape in the selected layout. When the layout is settled, a screen in FIG. 26 is displayed on the LCD panel 10.

Figure 26:
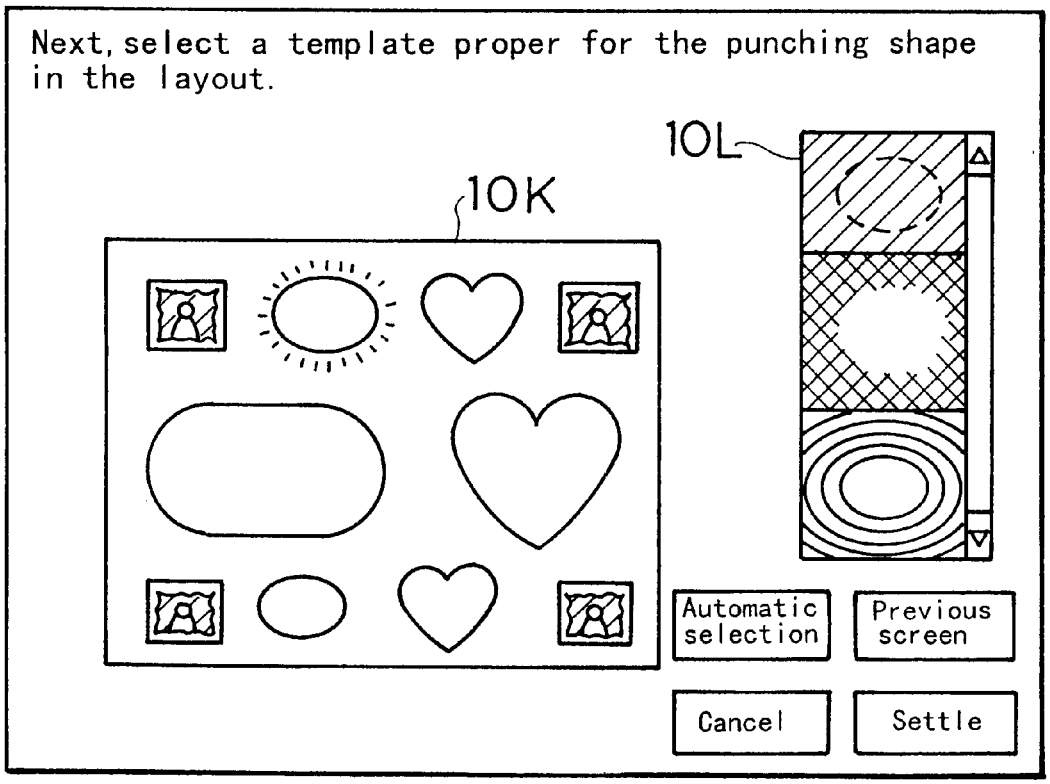
FIG. 26 is a view illustrating a screen of the LCD panel for selecting a template image proper for the punching shape in the layout.

As is the case with the screen in FIG. 17, the selected layout is shown on a display part 10K of the screen in FIG. 26, and a plurality of template images are shown on a display part 10L. The plurality of template images on the display part 10L are represented as selectable buttons, and a variety of buttons are displayed at the lower right of the screen.

FIG. 26 shows the state in which a template image proper for an oval punching shape is selected. This punching shape is blinking. Since the punching shape is an oval, the plurality of template images proper for the oval are shown on the display part 10L. A desired template image is touched among the plurality of template images shown on the display part 10L to select the template image. When the template image proper for the oval punching shape is selected, the selected template image is combined with the captured image, and the composite image is put in the oval punching shape. Then, the screen is switched so that the template image proper for a heart punching shape can be selected.

After the template images for all the punching shapes are selected in the above-mentioned manner, the image data representing a print image to be printed is created.

After the punching shapes and layouts are selected, the cutter assembly wheel is rotated to position the cutter roller that provides the selected layout at the predetermined using position (S308). Then, the positioned cutter roller is rotated until the leading end of the barcode of the cutter roller is detected so that the reference position of the cutter roller can be at the predetermined home position (S310).

The image is printed on the roll paper 20, the outer form of the printed image is half-cut, and the recording paper is full-cut in the same manner as S216–S230 in FIG. 15.

In these embodiments, the roll paper is used as the recording paper, but it is also possible to use a cut paper (sheet) for producing peel-off stickers. The cut paper comprises sticker paper and backing paper on which the sticker paper is attached. Images are printed on the sticker paper.

In these embodiments, the outer form of the printed image on the sticker paper is half-cut on the recording paper, so that each image can be peeled from the backing paper. For the same purpose, perforations for facilitating separation may be punctured in the sticker paper instead of the cutting.

In these embodiments, the cutter roller is used, but another type of cutter may also be used.

The printing method on the printing part is not restricted to the thermal printing. Another type of printing (ex., ink-jet printing) may also be performed.

The indicator indicating the type of the cutter is not restricted to the barcode. For instance, the indicator may also be a magnetic code. When the magnetic code is read, the cutter roller is rotated at a high speed. It is also possible to load a storage medium, which contains information about the cutter, in the cutter so that the storage medium can be read.

For the cutter phase indicator, it is possible to use a magnetic device, etc. other than the optical device such as the barcode, a hole and a chip.

As set forth hereinabove, according to the present invention, it is unnecessary to enter the size and layout of the image to be printed on the recording paper and edit the cutting method. If a desired cutting pattern is selected among the plurality of cutting patterns, one or more images can be printed on the recording paper in the size and layout proper for the selected cutting pattern, and the outer forms of one or more images can be cut quickly on the recording paper in the selected cutting pattern.

If the template image combined with the image to be printed is selected among the plurality of template images when the cutting pattern is selected, one or more composite images can be printed on the recording paper in the size and layout proper for the selected cutting pattern, and the outer forms of one or more composite images can be cut on the recording paper in the selected cutting pattern.

Furthermore, it is possible to make the sticker prints in arbitrary cutting patterns, sizes and layouts by adding a cutter or changing cutters.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image printing and cutting method comprising the steps of:

capturing image data representing an image to be printed;

selecting a cutting pattern from a plurality of cutting patterns;

printing at least one image represented by the captured image data in a size and layout proper for the selected cutting pattern onto recording paper; and cutting an outer form of at least one printed image on the recording paper in accordance with the selected cutting pattern.

2. The image printing and cutting method as defined in claim 1, wherein the cutting pattern selecting step comprises the step of displaying the cutting patterns on a display screen, the cutting pattern being selected on the display screen.

3. The image printing and cutting method as defined in claim 1, wherein:

the recording paper is a sheet of paper used for producing at least one peel-off sticker, the sheet comprising sticker paper and backing paper, the sticker paper being attached on the backing paper;

the image is printed on the sticker paper in the printing step; and only the sticker paper is cut and the backing paper is left uncut in the cutting step.

4. The image printing and cutting method as defined in claim 1, wherein:

the recording paper is roll paper used for producing at least one peel-off sticker, the roll paper comprising sticker paper and backing paper, the sticker paper being attached on the backing paper;

the image is printed on the sticker paper in the printing step;

only the sticker paper is cut and the backing paper is left uncut in the cutting step; and the image printing and cutting method further comprises the step of cutting the roll paper to a predetermined length by cutting both the sticker paper and the backing paper.

5. The image printing and cutting method as defined in claim 1, wherein in the cutting step, the cutting includes puncturing perforations for facilitating separation in the recording paper.

6. The image printing and cutting method as defined in claim 1, further comprising:

the step of providing a plurality of cutters provided with punching dies corresponding to the plurality of cutting patterns;

wherein one of the plurality of cutters providing the selected cutting pattern is used in the cutting step.

7. An image printing and cutting method comprising the steps of:

capturing image data representing an image to be printed;

selecting a cutting pattern from a plurality of cutting patterns;

selecting a template image proper for the selected cutting pattern from a plurality of template images represented by a plurality of pieces of template image data;

creating composite image data representing a composite image composed from the image to be printed and the selected template image by combining the captured image data and the template image data representing the selected template image;

printing at least one composite image in a size and layout proper for the selected cutting pattern onto recording paper; and cutting an outer form of at least one printed image on the recording paper in accordance with the selected cutting pattern.

8. The image printing and cutting method as defined in claim 7, wherein the cutting pattern selecting step comprises the step of displaying the cutting patterns on a display screen, the cutting pattern being selected on the display screen.

9. The image printing and cutting method as defined in claim 8, wherein the template image selecting step comprises the step of displaying only the template images proper for the selected cutting pattern on the display screen, the template image being selected on the display screen.

10. The image printing and cutting method as defined in claim 7, wherein the cutting pattern selecting step comprises the step of displaying the cutting patterns on a display screen, the cutting pattern being selected on the display screen.

11. The image printing and cutting method as defined in claim 7, wherein if the selected cutting pattern includes at least two cutting shapes, the template images respectively proper for the cutting shapes are selected in the template image selecting step.

12. The image printing and cutting method as defined in claim 7, wherein:

the recording paper is a sheet of paper used for producing at least one peel-off sticker, the sheet comprising sticker paper and backing paper, the sticker paper being attached on the backing paper;

the image is printed on the sticker paper in the printing step; and only the sticker paper is cut and the backing paper is left uncut in the cutting step.

13. The image printing and cutting method as defined in claim 7, wherein:

the recording paper is roll paper used for producing at least one peel-off sticker, the roll paper comprising sticker paper and backing paper, the sticker paper being attached on the backing paper;

the image is printed on the sticker paper in the printing step;

only the sticker paper is cut and the backing paper is left uncut in the cutting step; and the image printing and cutting method further comprises the step of cutting the roll paper to a predetermined length by cutting both the sticker paper and the backing paper.

14. The image printing and cutting method as defined in claim 7, wherein in the cutting step, the cutting includes puncturing perforations for facilitating separation in the recording paper.

15. The image printing and cutting method as defined in claim 7, further comprising:

the step of providing a plurality of cutters provided with punching dies corresponding to the plurality of cutting patterns;

wherein one of the plurality of cutters providing the selected cutting pattern is used in the cutting step.

16. An image printing and cutting method comprising the steps of:

capturing image data representing an image to be printed;

selecting a template image from a plurality of template images represented by a plurality of pieces of template image data;

selecting a cutting pattern proper for the selected template image from a plurality of cutting patterns;

creating composite image data representing a composite image composed from the image to be printed and the selected template image by combining the captured image data and the template image data representing the selected template image;

printing at least one composite image in a size and layout proper for the selected cutting pattern onto recording paper; and cutting an outer form of at least one printed image on the recording paper in accordance with the selected cutting pattern.

17. The image printing and cutting method as defined in claim 16, wherein the template image selecting step comprises the step of displaying the template images on a display screen, the template image being selected on the display screen.

18. The image printing and cutting method as defined in claim 16, wherein the cutting pattern selecting step comprises the step of displaying only the cutting patterns proper for the selected template image on a display screen, the cutting pattern being selected on the display screen.

19. The image printing and cutting method as defined in claim 16, wherein if the selected cutting pattern includes at least two cutting shapes, the template images respectively proper for the cutting shapes are selected in the template image selecting step.

20. The image printing and cutting method as defined in claim 16, wherein:

the recording paper is a sheet of paper used for producing at least one peel-off sticker, the sheet comprising sticker paper and backing paper, the sticker paper being attached on the backing paper;

the image is printed on the sticker paper in the printing step; and only the sticker paper is cut and the backing paper is left uncut in the cutting step.

21. The image printing and cutting method as defined in claim 16, wherein:

the recording paper is roll paper used for producing at least one peel-off sticker, the roll paper comprising sticker paper and backing paper, the sticker paper being attached on the backing paper;

the image is printed on the sticker paper in the printing step;

only the sticker paper is cut and the backing paper is left uncut in the cutting step; and the image printing and cutting method further comprises the step of cutting the roll paper to a predetermined length by cutting both the sticker paper and the backing paper.

22. The image printing and cutting method as defined in claim 16, wherein in the cutting step, the cutting includes puncturing perforations for facilitating separation in the recording paper.

23. The image printing and cutting method as defined in claim 16, further comprising:

the step of providing a plurality of cutters provided with punching dies corresponding to the plurality of cutting patterns;

wherein one of the plurality of cutters providing the selected cutting pattern is used in the cutting step.

* * * * *